US009377736B2

(12) United States Patent
Miyajima

(10) Patent No.: US 9,377,736 B2
(45) Date of Patent: Jun. 28, 2016

(54) IMAGE FORMING APPARATUS, CONTROL METHOD THEREFOR, AND STORAGE MEDIUM FOR SHEET ORDERING BASED ON IMAGE RESOLUTION

(75) Inventor: Jun Miyajima, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 321 days.

(21) Appl. No.: 13/596,650

(22) Filed: Aug. 28, 2012

(65) Prior Publication Data

US 2013/0058694 A1 Mar. 7, 2013

(30) Foreign Application Priority Data

Sep. 5, 2011 (JP) ..... 2011-193275

(51) Int. Cl.
*G03G 15/00* (2006.01)
*G03G 13/00* (2006.01)
*G03G 15/23* (2006.01)

(52) U.S. Cl.
CPC ..... *G03G 15/234* (2013.01); *G03G 15/6564* (2013.01); *G03G 15/235* (2013.01); *G03G 2215/00599* (2013.01); *G03G 2215/00949* (2013.01)

(58) Field of Classification Search
CPC ..... G03G 15/5008; G03G 15/505; G03G 15/234; G03G 2215/00075; G03G 2215/0008; G03G 2215/00945; G03G 2215/00949; G03G 2215/0196; B41J 2002/0052; G06K 15/1223
USPC ..... 399/401, 396, 398, 388; 358/1.2, 1.5, 358/1.6; 271/291
See application file for complete search history.

(56) References Cited

U.S. PATENT DOCUMENTS

| | | | | |
|---|---|---|---|---|
| 6,539,198 | B2 | 3/2003 | Miyajima | |
| 2002/0048465 | A1 | 4/2002 | Kuwabara | |
| 2010/0014884 | A1 * | 1/2010 | Roppongi | 399/82 |
| 2010/0129094 | A1 | 5/2010 | Maeda et al. | |

FOREIGN PATENT DOCUMENTS

| | | | |
|---|---|---|---|
| CN | 1671178 | A | 9/2005 |
| JP | 2000-181275 | A | 6/2000 |
| JP | 2001-022138 | A | 1/2001 |
| JP | 2002-023576 | A | 1/2002 |
| JP | 3768785 | B | 4/2006 |

OTHER PUBLICATIONS

Chinese Office Action issued in corresponding application No. 201210323472.1 on Sep. 5, 2014.

* cited by examiner

*Primary Examiner* — Blake A Tankersley
*Assistant Examiner* — Quang X Nguyen
(74) *Attorney, Agent, or Firm* — Carter, DeLuca, Farrell & Schmidt, LLP

(57) ABSTRACT

The number of circulatable sheets and the conveying speed of a sheet are decided by referring to a storage unit which stores the number of circulatable sheets and the conveying speed of a sheet in correspondence with the type and size of a sheet, and the resolution of an image to be printed. It is determined whether the conveying speed of the feed surface of a sheet to be fed next to the printing unit and that of a feed surface to be refed next to the printing unit coincide with each other. It is determined whether the conveying speed of the feed surface of the sheet to be fed next to the printing unit and that of the feed surface or the refeed surface of a sheet immediately previously fed to the printing unit differ from each other.

8 Claims, 19 Drawing Sheets

FIG. 9

| PAPER SIZE | PAPER TYPE | RESOLUTION | CIRCULATING SHEET COUNT | CONVEYING SPEED |
|---|---|---|---|---|
| A4 | PLAIN PAPER | 600dpi | 5 | CONSTANT SPEED |
| A4 | PLAIN PAPER | 1200dpi | 5 | HALF SPEED |
| A4 | THICK PAPER | 600dpi | 5 | HALF SPEED |
| A4 | THICK PAPER | 1200dpi | 5 | HALF SPEED |
| A3 | PLAIN PAPER | 600dpi | 3 | CONSTANT SPEED |
| A3 | PLAIN PAPER | 1200dpi | 3 | HALF SPEED |
| A3 | THICK PAPER | 600dpi | 3 | HALF SPEED |
| A3 | THICK PAPER | 1200dpi | 3 | HALF SPEED |

IMAGE FORMING APPARATUS, CONTROL METHOD THEREFOR, AND STORAGE MEDIUM FOR SHEET ORDERING BASED ON IMAGE RESOLUTION

BACKGROUND OF THE INVENTION

1. Field of the Invention

The present invention relates to an image forming apparatus capable of executing double-sided printing, a control method therefor, and a storage medium.

2. Description of the Related Art

Recently, printers have achieved high resolutions, with printers having resolutions of 600 dpi (dots/inch) and 1,200 dpi making their debuts. Those printers switch the resolution between 600 dpi and 1,200 dpi by changing the conveying speed of printing paper (sheet). More specifically, when a sheet conveying speed corresponding to 600 dpi is defined as the first constant speed, printing at a 1,200-dpi double resolution is implemented by conveying a sheet at a speed (half speed) that is half the first constant speed. Therefore, in 1,200-dpi printing, the sheet conveying speed is halved, halving the productivity of 600 dpi printing. To implement 1,200-dpi printing at the first constant speed, the rotational speed of a polygon mirror which scans a laser beam is doubled, or the number of laser beams is doubled, raising the hardware cost. To implement high-resolution printing at low cost, switching of the resolution by switching the conveying speed is an indispensable technique. For example, Japanese Patent Laid-Open Nos. 2000-181275 and 2002-23576 have proposed this technique.

As a method of forming images on the obverse and reverse surfaces of many sheets, a circulation paper conveying method is used. In this method, a sheet is sent to a transfer unit configured to transfer an image, and an image is printed on one surface of the sheet. The sheet is then sent to an inversion unit and inverted. The inversed sheet is then sent again to the transfer unit, and an image is transferred on the reverse surface, thereby printing images on the two surfaces of the sheet. To increase productivity by shortening the interval between sheets, double-sided circulation control is performed in double-sided printing. More specifically, instead of feeding and refeeding one sheet, a plurality of sheets are fed at once to successively print images on their first surfaces, and the sheets each bearing the image on the first surface are sent to a double-sided path. Then, images for the first surfaces of newly fed sheets, and images for the second surfaces of the sheets conveyed via the double-sided path are alternately printed.

As an image forming apparatus using the circulation paper conveying method, Japanese Patent No. 03768785 has proposed an image forming apparatus which decides a double-sided circulating sheet count based on the paper size and paper type of a sheet to be fed. Even if there is a sheet to be printed subsequently, control to temporarily interrupt double-sided circulation is performed under a given condition. For example, when the paper size switches from A4 to A3, double-sided circulation is interrupted. This is because the circulating sheet count switches depending on the paper size and paper type. Also, when the paper type switches (from plain paper to thick paper), double-sided circulation is interrupted because the conveying speed switches.

Conventional sheet double-sided circulation control in Japanese Patent No. 03768785 is executed for each sheet. This is because the double-sided circulating sheet count is obtained based on sheet information such as "paper size" and "paper type". The sheet conveying speed is also switched based on "paper type". This is because the conveying speed is decreased for a sheet having a large grammage such as thick paper, so as to increase the heat capacity and implement stable fixing.

However, in Japanese Patent No. 03768785, whether to interrupt double-sided circulation is determined not based on the resolution but based on sheet information such as "paper size" and "paper type". For this reason, even if the conveying speed changes between printing sheets when printing images having different resolutions on a plurality of printing sheets, double-sided circulation cannot be properly interrupted, generating a jam.

SUMMARY OF THE INVENTION

The present invention enables realization of a technique capable of preventing generation of a sheet jam and continuously executing double-sided printing even if a plurality of images having different resolutions are printed on respective printing sheets when executing double-sided printing on a plurality of printing sheets.

One aspect of the present invention provides an image forming apparatus arranged to perform image formation on the surfaces of a double-sided sheet by image forming on a first surface of the fed sheet, re-feeding the sheet, and image forming on a second surface of the sheet, the image forming apparatus comprising: an image forming unit configured to form images on the sheet; a circulating path configured to re-feed the sheet to the image forming unit following forming of an image on the first surface of the sheet and after inverting the sheet to enable an image to be formed on the second surface of the sheet; a deciding unit configured to decide a conveying speed of the sheet in accordance with a resolution of the images to be formed by the image forming unit; a comparing unit configured to compare the conveying speed of a subsequent sheet to be fed to the image forming unit, in order that an image can be formed by the image forming unit on a first surface of the subsequent sheet, and the conveying speed of a previous sheet which was fed immediately before the subsequent sheet, in order that an image can be formed by the image forming unit on the second surface of the previous sheet and a feeding control unit configured to control a feeding timing of the subsequent sheet based on the output of the comparing unit.

Another aspect of the present invention provides a method of an image forming apparatus arranged to perform image formation on the surfaces of a double-sided sheet by image forming on a first surface of the fed sheet, re-feeding the sheet, and image forming on a second surface of the sheet, the method comprising: feeding the sheet to an image forming unit arranged to form images on the sheet; re-feeding the sheet to the image forming unit following forming of an image on the first surface of the sheet and after inverting the sheet to enable an image to be formed on the second surface of the sheet; deciding a conveying speed of the sheet in accordance with a resolution of the images to be formed by the image forming unit; comparing the conveying speed of a subsequent sheet to be fed to the image forming unit, in order that an image can be formed by the image forming unit on a first surface of the subsequent sheet, and the conveying speed of a previous sheet which was fed immediately before the subsequent sheet, in order that an image can be formed by the image forming unit on the second surface of the previous sheet; and controlling a feeding timing of the subsequent sheet based on the output of the comparing step.

Still another aspect of the present invention provides a computer-readable storage medium storing a computer program for causing a computer to execute each step in a method for controlling an image processing apparatus.

Further features of the present invention will be apparent from the following description of embodiments with reference to the attached drawings.

BRIEF DESCRIPTION OF THE DRAWINGS

FIG. 9 is a table exemplifying a table used to obtain a circulating sheet count and conveying speed from a paper size, paper type, and resolution in the image forming apparatus according to the first embodiment;

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise. Each of the embodiments of the present invention described below can be implemented solely or as a combination of a plurality of the embodiments or features thereof where necessary or where the combination of elements or features from individual embodiments in a single embodiment is beneficial.

First Embodiment

Figure 1:
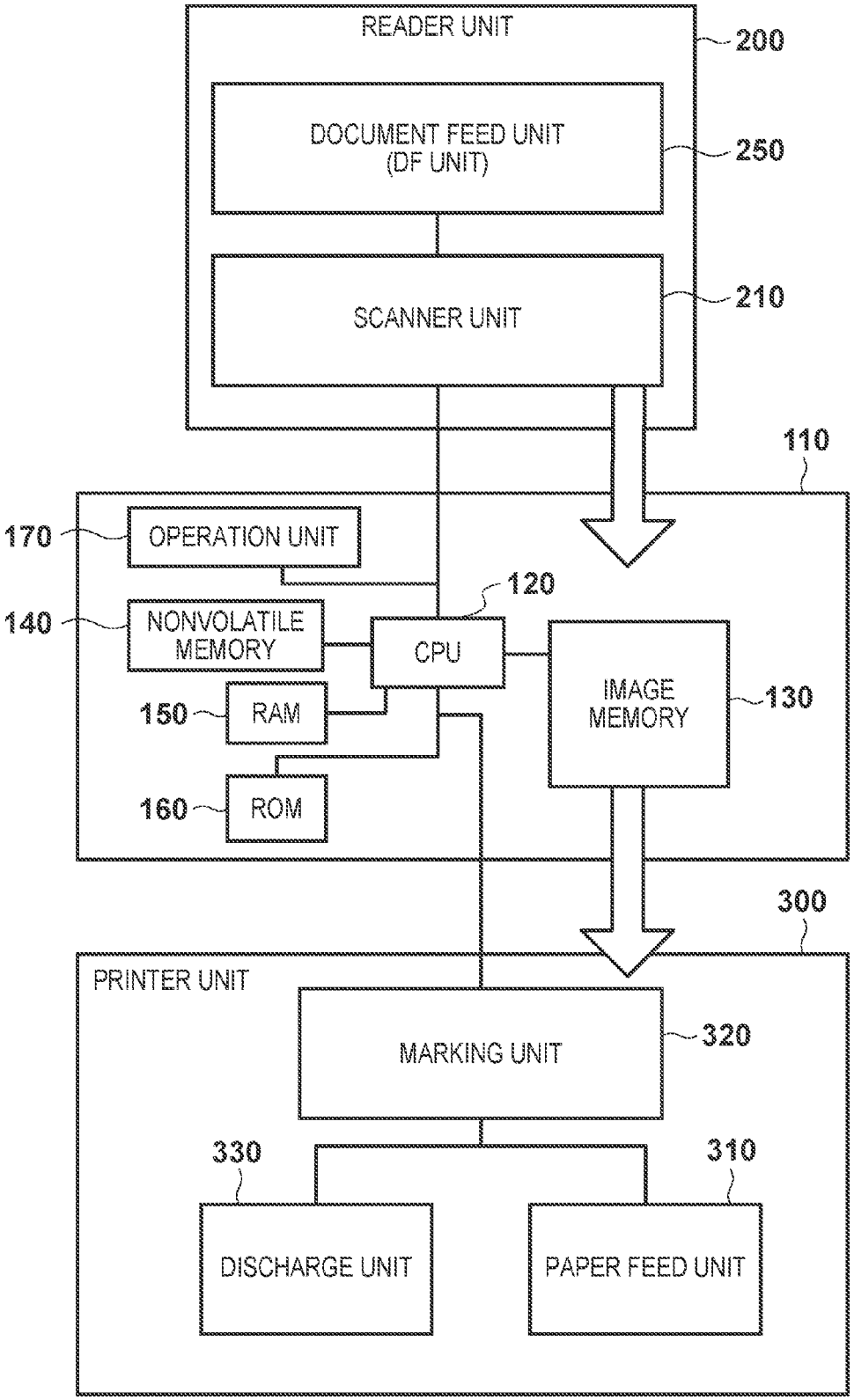
FIG. 1 is a block diagram showing the overall arrangement of an image input/output system to which an image forming apparatus (multi-function peripheral) according to an embodiment of the present invention is applicable.

FIG. 1 is a block diagram showing the overall arrangement of an image input/output system (printing system) to which an image forming apparatus (multi-function peripheral) according to an embodiment of the present invention is applicable.

A reader unit (image input apparatus) 200 optically reads a document image and converts it into image data. The reader unit 200 includes a scanner unit 210 having a function of reading a document, and a document feed unit (DF unit) 250 having a function of conveying a document to be read.

A printer unit (image output apparatus) 300 conveys a sheet, prints image data as a visible image on it, and discharges the sheet from the apparatus. The printer unit 300 includes a paper feed unit 310 including a plurality of types of sheet cassettes, a marking unit 320 having a function of transferring and fixing image data onto a sheet, and a discharge unit 330 having a function of outputting a printed sheet from the apparatus.

A control unit 110 includes a CPU 120, image memory 130, nonvolatile memory 140, RAM 150, ROM 160, and operation unit 170. The control unit 110 is electrically connected to the reader unit 200 and printer unit 300. The CPU 120 in the control unit 110 provides a copy function by controlling the reader unit 200 to load image data of a document into the image memory 130, and controlling the printer unit 300 to output image data in the image memory 130 onto a sheet. The nonvolatile memory 140 stores various adjustment values. The RAM 150 is used as the work area of the CPU 120, and the ROM 160 stores a control program for the CPU 120. The operation unit 170 includes an LCD touch panel 360 (FIG. 3) including a liquid crystal display unit and a touch panel adhered to the liquid crystal display unit, and a plurality of hard keys. A signal input via the touch panel or hard key is transferred to the CPU 120, and the liquid crystal display unit displays functions, image data, and the like in accordance with an operation to the image forming apparatus.

Figure 2:
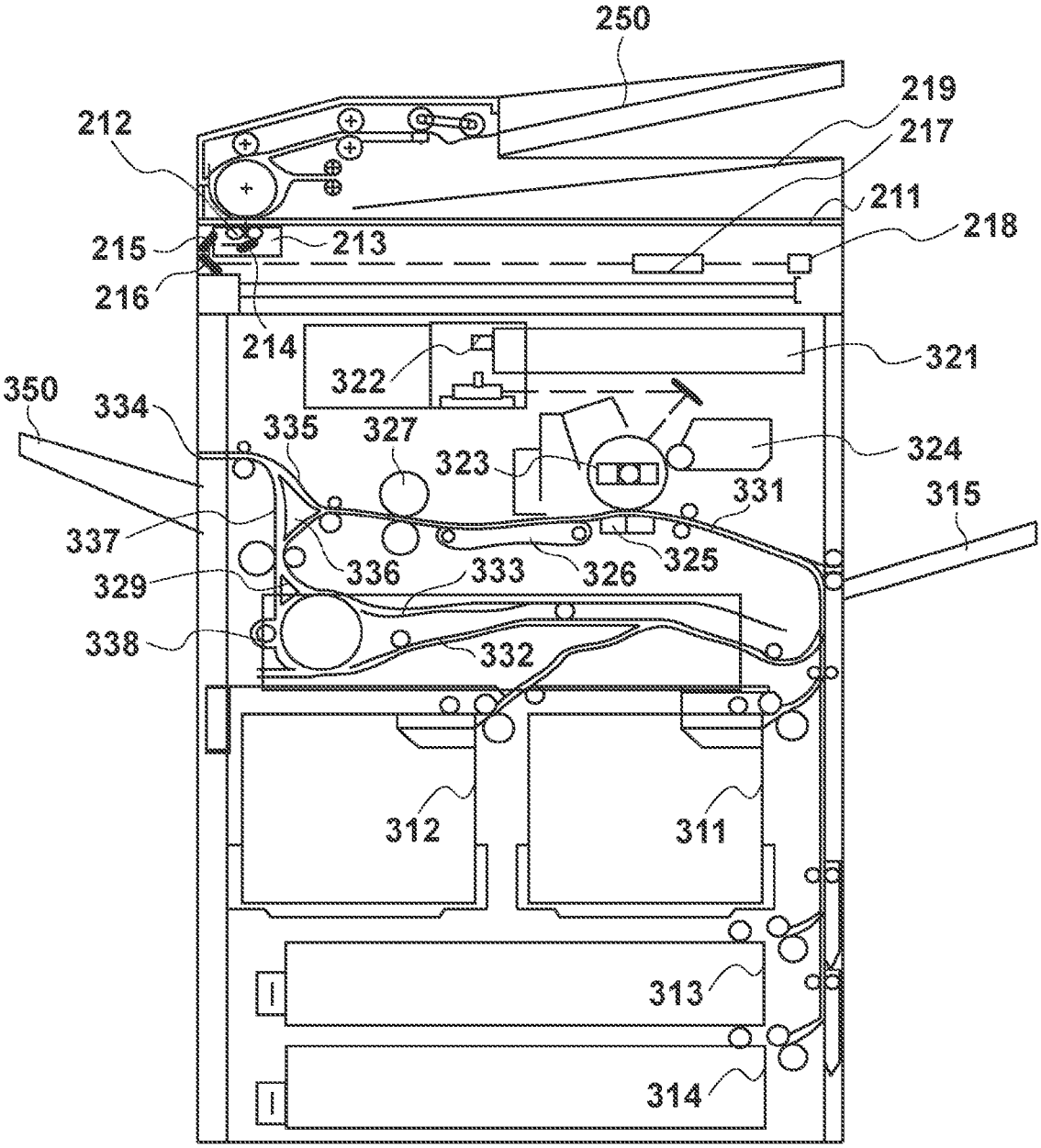
FIG. 2 is a sectional view for explaining the arrangements of a reader unit and printer unit.

FIG. 2 is a sectional view for explaining the arrangements of the reader unit 200 and printer unit 300.

First, the reader unit 200 will be explained.

In the reader unit 200, the document feed unit (DF unit) 250 feeds document sheets sequentially one by one from the top onto a platen glass 211, and after the end of a document reading operation, discharges the document sheet on the platen glass 211 to a discharge tray 219. When a document sheet is conveyed onto the platen glass 211, a lamp 212 is turned on, an optical unit 213 starts moving, and the document sheet is exposed and scanned. Light reflected by the document sheet is guided to a CCD image sensor (to be referred to as CCD hereinafter) 218 by mirrors 214, 215, and 216 and a lens 217. The CCD 218 reads the image of the scanned document. Image data output from the CCD 218 undergoes predetermined processing, and is transferred to the control unit 110.

Next, the printer unit 300 will be explained.

A laser driver 321 drives a laser emitting unit 322, and causes the laser emitting unit 322 to emit a laser beam corresponding to image data output from the control unit 110. The laser beam irradiates a photosensitive drum 323 via a polygon mirror, forming a latent image corresponding to the laser beam on the surface of the photosensitive drum 323. A developing unit 324 applies a developer to the latent image on the photosensitive drum 323.

In the printer unit 300, the paper feed unit includes paper feed cassettes 311, 312, 313, and 314 each having a drawer shape. The paper feed unit 310 further includes a manual paper feed tray 315. The printer unit 300 feeds a sheet from one of the paper feed cassettes 311, 312, 313, and 314 and the manual paper feed tray 315, and conveys it to a transfer unit (printing unit) 325 via a conveying path 331. The transfer unit 325 transfers, onto the sheet, the developer applied to the photosensitive drum 323. A conveyor belt 326 conveys the developer-transferred sheet to a fixing unit 327, and the developer is fixed to the sheet by the heat and pressure of the fixing unit 327. The sheet having passed through the fixing unit 327 passes through conveying paths 335 and 334 and is discharged. When inverting the printed surface and discharging a sheet, the sheet is guided to conveying paths 336 and 338, then conveyed in the reverse direction from the conveying path 338, and passes through a conveying path 337 and the conveying path 334. When double-sided printing is set, a sheet having passed through the fixing unit 327 is guided from the conveying path 336 to a conveying path 333 by a flapper 329. Then, the sheet is conveyed in the reverse direction, and guided to the conveying path 338 and a paper refeed conveying path 332 (circulating path) by the flapper 329. The printed sheet guided to the paper refeed conveying path 332 passes through a conveying path 331 at the above-described timing, and fed again to the transfer unit 325. Note that a sheet discharged from the conveying path 334 is conveyed to a discharge bin 350 regardless of single- or double-sided printing.

Next, the operation unit 170 will be described with reference to FIG. 3.

Figure 3:
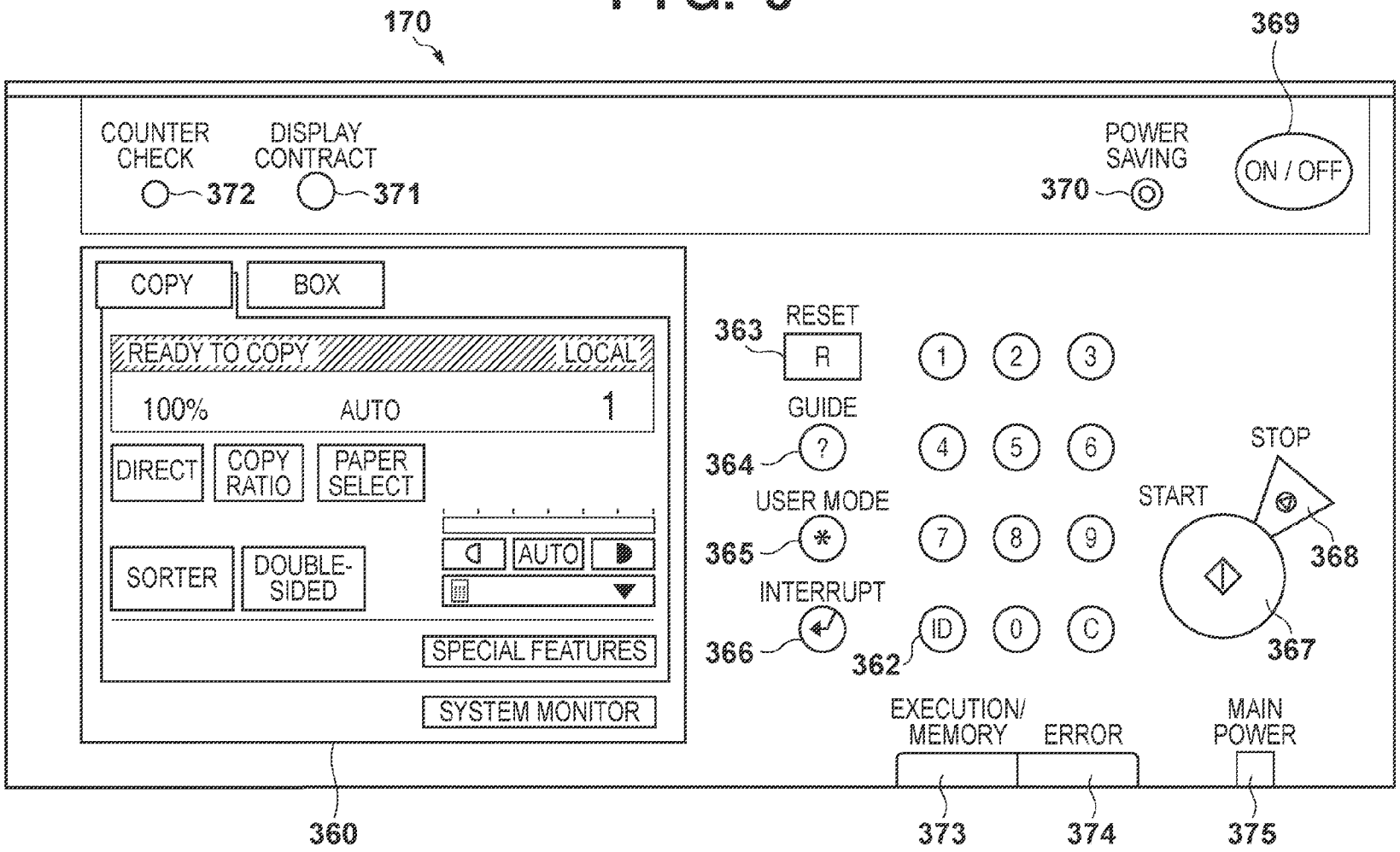
FIG. 3 is a plan view showing an operation unit according to the first embodiment.

FIG. 3 is a plan view showing the operation unit 170 according to the first embodiment.

An LCD touch panel 360 is used when the user makes main mode settings and displays a status. A ten-key pad 361 is used when the user enters a numerical value of 0 to 9. An ID key 362 is used to enter a department number and password mode when the multi-function peripheral is managed. A reset key 363 is used to reset a set mode. A guide key 364 is used to display an explanation screen for each mode. A user mode key 365 is used to enter a user mode screen. An interrupt key 366 is used to perform interrupt copying. A start key 367 is used to start a copy operation. A stop key 368 is used to stop a running copy job. When the user presses a soft power SW 369, the backlight of the LCD touch panel 360 is turned off, and the multi-function peripheral shifts to a low-power state. When the user presses a power saving key 370, the multi-function peripheral enters the power saving state, and when he presses the power saving key 370 again, returns from the power saving state.

An adjustment key 371 is used to adjust the contrast of the LCD touch panel 360. When the user presses a counter check key 372, a count screen appears on the LCD touch panel 360 and displays a total copy count used until now. An LED 373 represents that a job is being executed and an image is being accumulated in the image memory. An error LED 374 represents that the multi-function peripheral is in an error status such as generation of a jam or opening of the door. An LED 375 is a power LED representing that the main switch of the multi-function peripheral is ON.

A sheet conveying method when forming an image will be explained with reference to FIGS. 4 to 6B.

Figure 4:
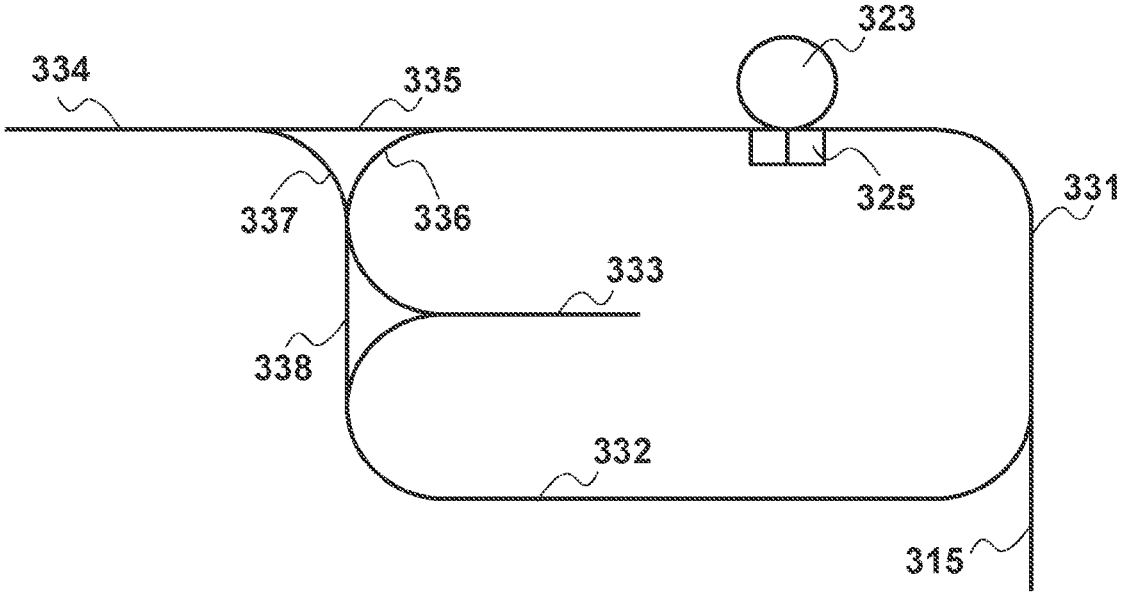
FIG. 4 is a schematic view showing the conveyance state of a sheet in the printer unit.

FIG. 4 is a schematic view showing the conveyance state of a sheet in the printer unit 300. The same reference numerals as those in FIG. 2 denote the same parts. In the following description, the paper feed tray is limited to the manual paper feed tray 315. However, the following description also applies to the paper feed cassettes 311, 312, 313, and 314.

Figure 5A:
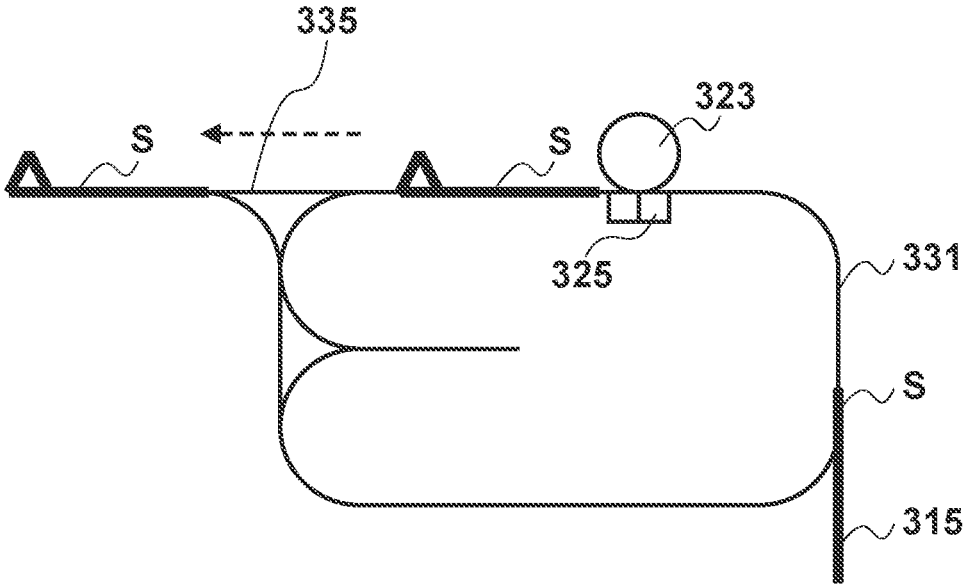
FIGS. 5A and 5B are views for explaining a method of conveying a sheet to undergo single-sided printing.
Figure 5B:
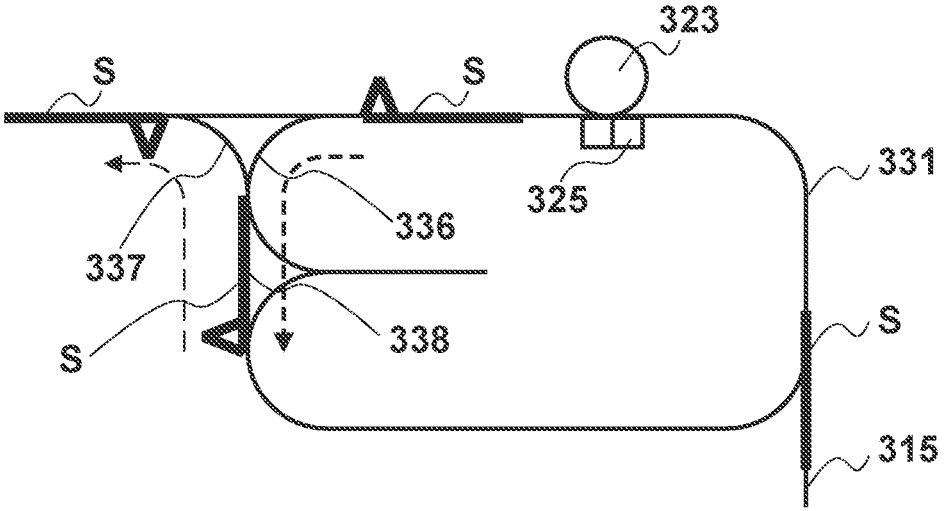

FIG. 4 corresponds to a state in which no sheet is conveyed to the conveying path. FIGS. 5A and 5B correspond to a method of conveying a sheet to undergo single-sided printing.

When performing single-sided printing, a sheet S fed from the manual paper feed tray 315 passes through the conveying path 331 and is conveyed to the transfer unit 325, as shown in FIG. 5A. The sheet S on which an image has been transferred (in FIG. 5A, Δ represents a transferred image) passes through the conveying path 335 and is discharged. In this case, the sheet S is discharged with the transferred image facing up.

When discharging the sheet S with the transferred image facing down, the sheet S on which an image has been transferred by the transfer unit 325 passes through the conveying paths 336 and 338, is then conveyed in the reverse direction from the conveying path 338, passes through the fixing unit 327, and is discharged, as shown in FIG. 5B. By switching back the sheet S bearing an image printed on one surface, the sheet S can be discharged with the transferred image facing down.

Figure 6A:
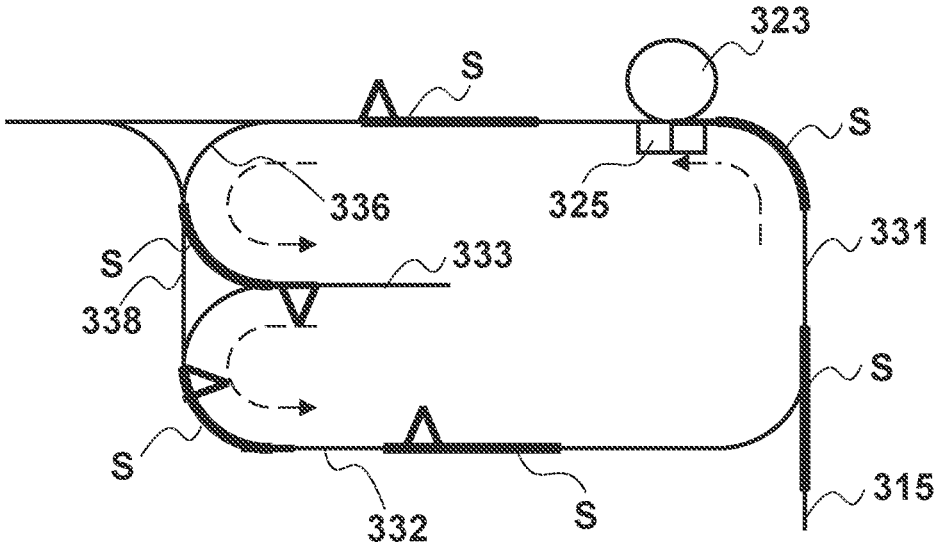
FIGS. 6A and 6B are views for explaining a method of conveying a sheet to undergo double-sided printing.
Figure 6B:
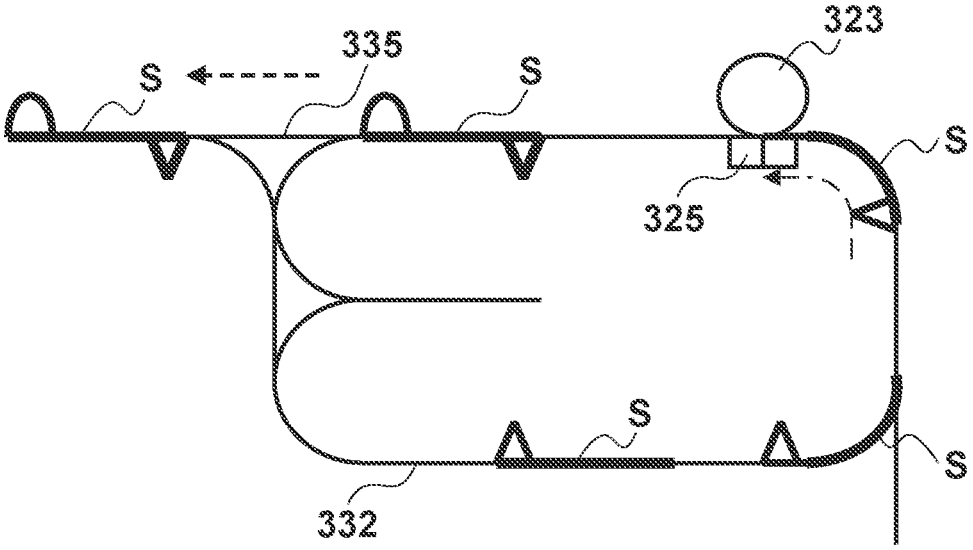

A sheet conveying method when performing double-sided printing will be explained with reference to FIGS. 6A and 6B. FIGS. 6A and 6B are schematic views showing the conveyance state of a sheet when the printer unit 300 performs double-sided printing. The same reference numerals as those in FIG. 2 denote the same parts. In the following description, the paper feed tray is the manual paper feed tray 315. However, the following description also applies to the paper feed cassettes 311, 312, 313, and 314.

Referring to FIG. 6A, when forming an image on the obverse surface of a sheet to undergo double-sided printing, the sheet S fed from the manual paper feed tray 315 passes through the conveying path 331 and is conveyed to the transfer unit 325. The sheet S on which an image has been transferred (in FIG. 6A, Δ represents a transferred obverse-surface image) is guided from the conveying path 336 to the conveying path 333, then conveyed in the reverse direction, and guided again to the conveying path 338 and paper refeed conveying path 332.

As shown in FIG. 6B, the sheet S which is present on the paper refeed conveying path 332 and bears the image transferred on the obverse surface (one surface) is refed to the conveying path 331 and conveyed to the transfer unit 325 at a proper timing. After that, an image is transferred onto the reverse surface (the other surface) (in FIG. 6B, a semiellipse represents a transferred reverse-surface image). The sheet S bearing the images on the two surfaces passes through the conveying path 335 and is discharged from the apparatus.

Figure 7A:
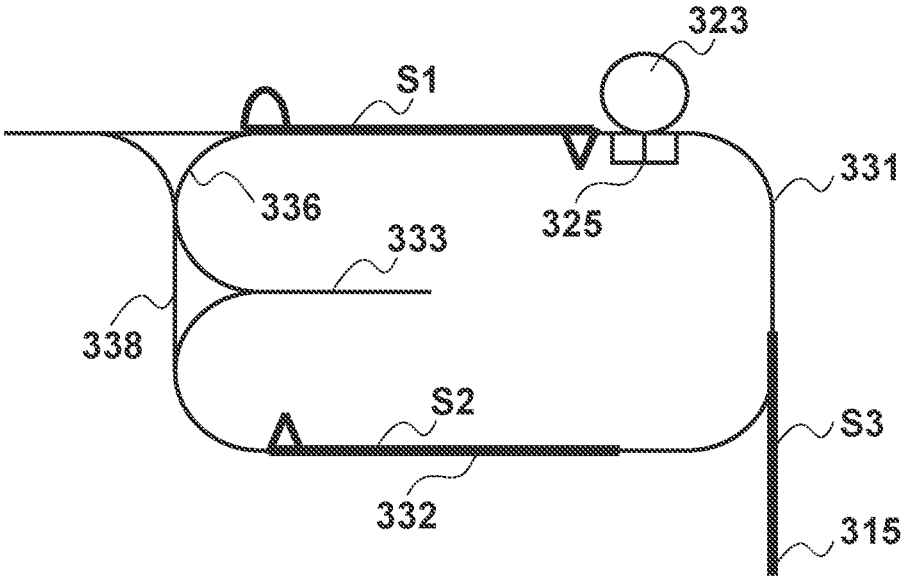
FIGS. 7A and 7B are schematic views for explaining a sheet conveying method when performing circulating double-sided printing.
Figure 7B:
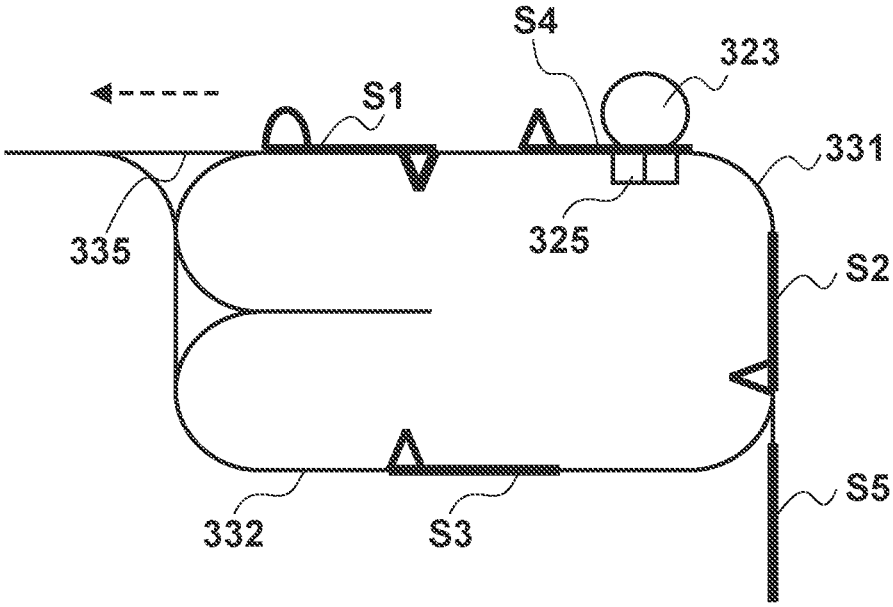

A sheet conveying method (paper feed control) when performing circulating double-sided printing will be explained with reference to FIGS. 7A and 7B. FIGS. 7A and 7B are schematic views showing the conveyance state of a plurality of sheets when the printer unit 300 performs circulating double-sided printing. The same reference numerals as those in FIG. 2 denote the same parts. In the following description, the paper feed tray is the manual paper feed tray 315. However, the following description also applies to the paper feed cassettes 311, 312, 313, and 314.

FIG. 7A shows the conveying order of sheets present on the paper conveying path when three sheets are circulated. In FIG. 7A, S1 to S3 represent the conveying order of sheets present on the paper conveying path.

FIG. 7B shows the conveying order of sheets present on the paper conveying path when five sheets are circulated. In FIG. 7B, S1 to S5 represent the conveying order of sheets present on the paper conveying path.

The circulating sheet count changes mainly depending on the sheet size because the length of the conveying path is determined. For small-size sheets, a large number of sheets can be fed in advance and circulated. To the contrary, for large-size sheets, only a small number of sheets can be fed in advance, decreasing the circulating sheet count.

Figure 8A:
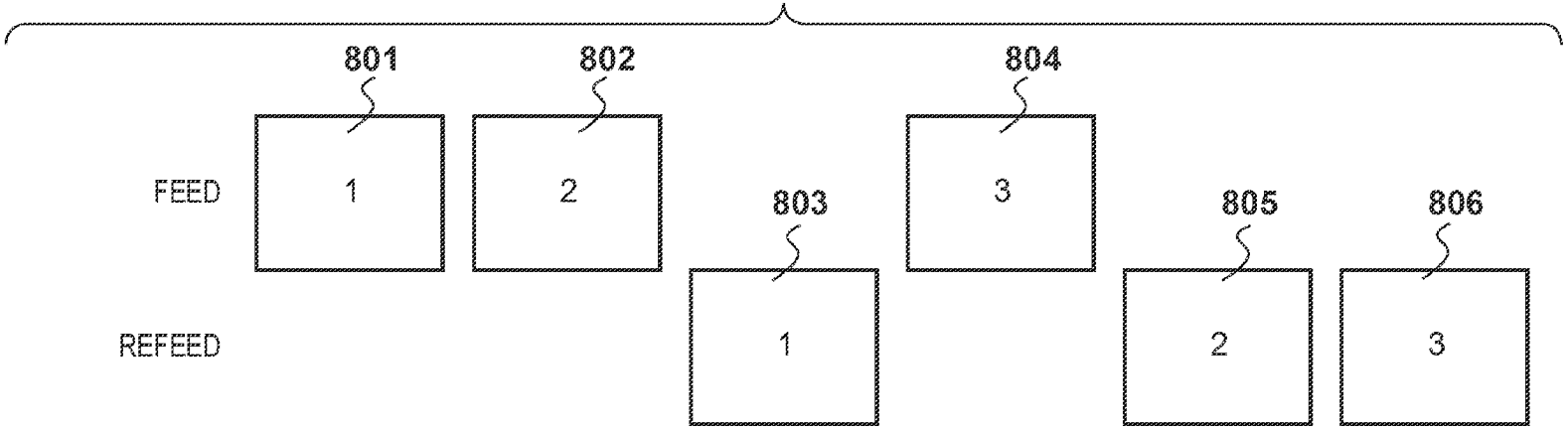
FIGS. 8A and 8B are schematic views showing a paper feed order in circulating image formation in an image forming apparatus according to the first embodiment.
Figure 8B:
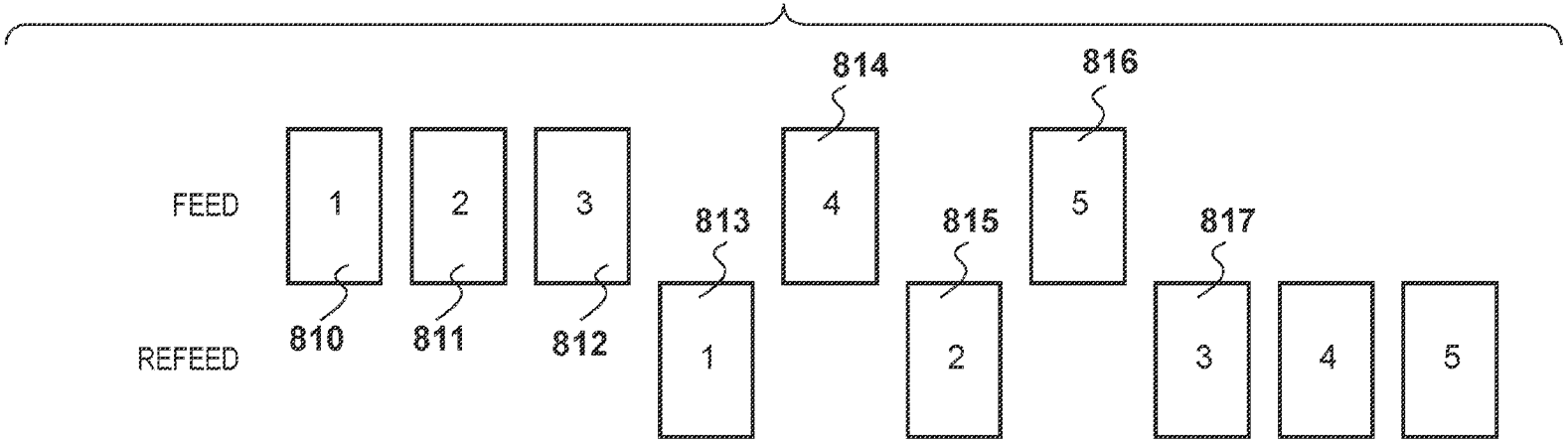

FIGS. 8A and 8B are schematic views showing a paper feed order in circulating image formation in the image forming apparatus according to the first embodiment. FIG. 8A shows a paper feed order when three sheets are circulated (circulating sheet count is three). FIG. 8B shows a paper feed order when five sheets are circulated (circulating sheet count is five). In FIGS. 8A and 8B, a numeral of 1 to 5 on each sheet represents the ordinal number of the sheet.

As shown in FIG. 8A, when performing three-sheet circulating printing in double-sided printing, the obverse surface of the first sheet is fed in 801, and then the obverse surface of the second sheet is fed in 802, instead of refeeding the reverse surface of the first sheet. The reverse surface of the first sheet fed previously is refed in 803, and the obverse surface of the third sheet is fed in 804. The reverse surface of the second sheet is refed in 805, and the reverse surface of the third sheet is fed in 806. These processes continue for every three sheets.

FIG. 8B is a view for explaining a case in which five-sheet circulating printing is performed in double-sided printing. In this case, the obverse surface of the first sheet is fed in 810, and then the obverse surface of the second sheet is fed in 811, instead of refeeding the reverse surface of the first sheet. In 812, the obverse surface of the third sheet is fed, instead of refeeding the reverse surface of the first sheet, unlike three-sheet circulation. The reverse surface of the first sheet fed previously is refed in 813, and the obverse surface of the fourth sheet is fed in 814. The reverse surface of the second sheet is refed in 815, and the obverse surface of the fifth sheet is fed in 816. In 817 and subsequent processes, the reverse surfaces of the third to fifth sheets are refed. These processes continue for every five sheets.

The circulating sheet count changes to three or five in order to efficiently perform double-sided printing at different sheet sizes on the same paper path.

FIG. 9 is a table exemplifying a table used to obtain a circulatable sheet count and conveying speed from a paper size, paper type, and resolution in the image forming apparatus according to the first embodiment. The table is stored in the ROM 160 or nonvolatile memory 140 of the control unit 110.

The circulating sheet count is basically decided from the paper (sheet) size. For example, as shown in FIG. 9, the circulating sheet count is "5" when the paper size is "A4", and "3" when the paper size is "A3".

The conveying speed is decided from the paper type and resolution. For example, the conveying speed is a constant speed when the paper type is "plain paper" and the resolution is "600 dpi", and a half speed when the paper type is "thick paper" because of the following reason. A developer is fixed to a sheet by the heat and pressure of the fixing unit 327. However, it is hard to transfer heat to a sheet of the paper type "thick paper". In this case, the conveying speed is decreased to a half speed so that a larger amount of heat can be transferred to the sheet, implementing stable fixing.

Also, when the resolution is 1,200 dpi, the conveying speed becomes a half speed in order to form a high-resolution latent image on the photosensitive drum 323 with the same number of laser beams at the same rotational speed of the polygon mirror as those for 600 dpi, and transfer, to a sheet by the transfer unit 325, the developer applied to the photosensitive drum 323.

Sheet conveyance control in a conventional image forming apparatus and the image forming apparatus according to the first embodiment will be described with reference to FIGS. 10 to 12.

Figure 10:
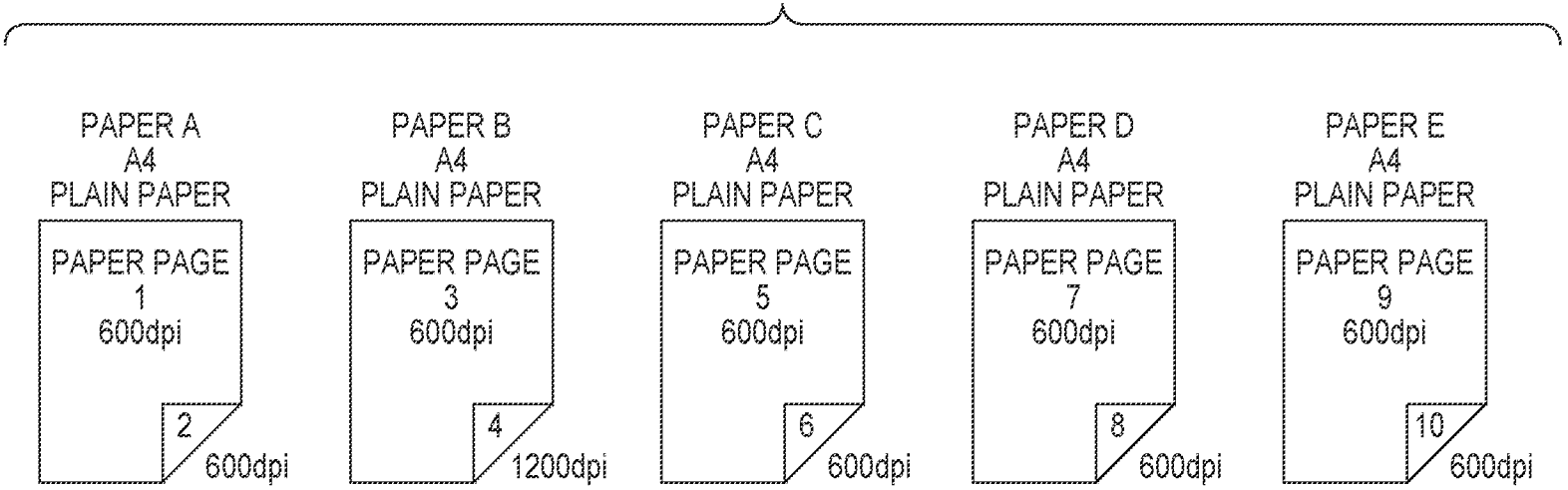
FIG. 10 is a view for explaining paper (sheet) used in printing, its size, its paper type, images to be printed on the two surfaces of each sheet, and the resolution.

FIG. 10 is a view for explaining paper (sheet) used in printing, its size, its paper type, images to be printed on the two surfaces of each sheet, and the resolution.

All paper A to paper E have the paper size "A4" and paper type "plain paper". The resolutions of images to be printed on these sheets are 600 dpi except for the refeed surface (reverse surface) (fourth document page) of paper B. The resolution of the refeed surface (reverse surface) (fourth document page) of paper B is 1,200 dpi. In FIGS. 10 to 12, a 1200-dpi printing surface is hatched.

Figure 11:
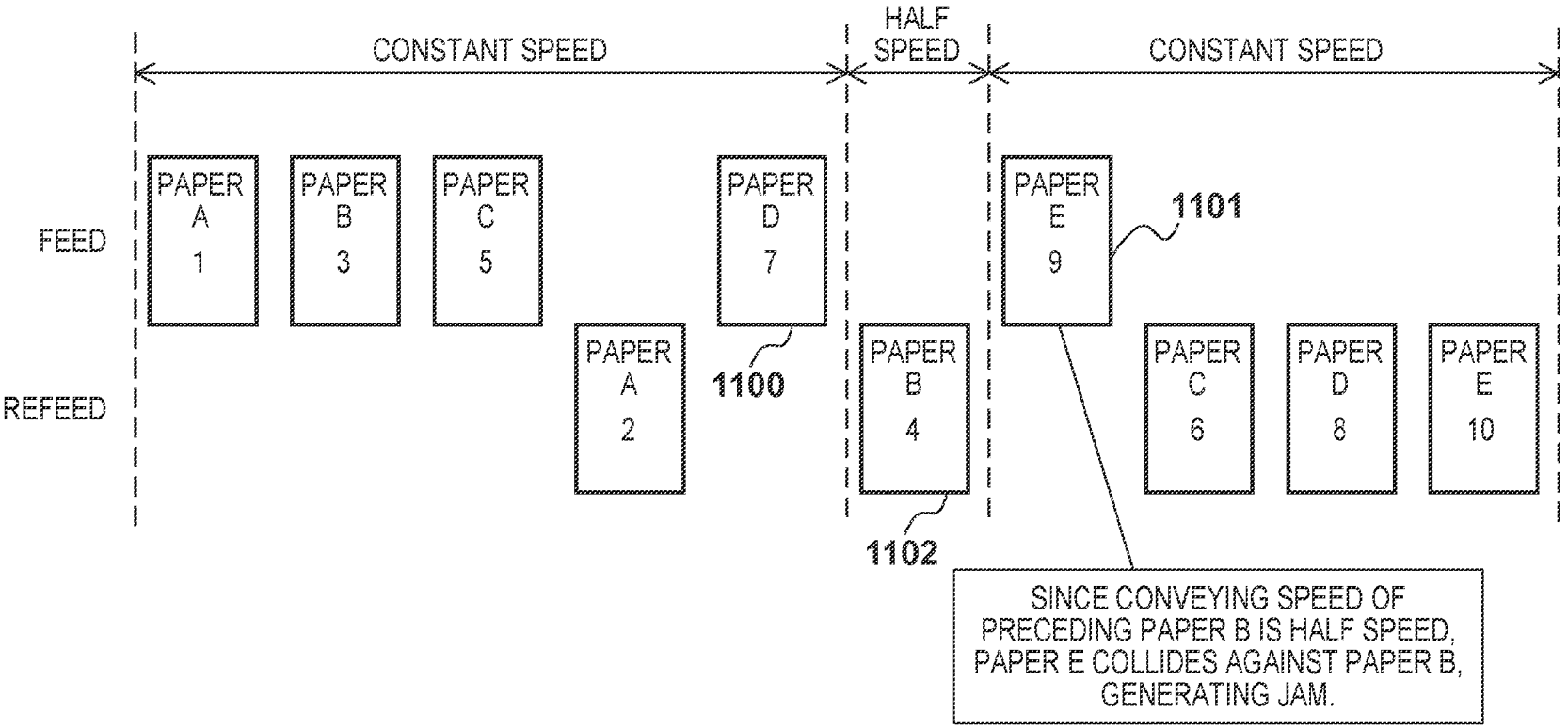
FIG. 11 is a view for explaining sheet conveyance control in a conventional image forming apparatus.

FIG. 11 is a view for explaining sheet conveyance control in the conventional image forming apparatus. Since the paper size is "A4" and the paper type is "plain paper", the circulating sheet count in double-sided printing is "5" based on the table of FIG. 9.

It is determined whether to continue double-sided circulation by feeding the feed surface (fifth document page) of paper C after feeding the feed surface (third document page) of paper B, or interrupt double-sided circulation by refeeding the refeed surface (second document page) of paper A and the refeed surface (fourth document page) of paper B. In sheet conveyance control of the conventional image forming apparatus, the circulating sheet count and conveying speed in double-sided printing are obtained from the paper size and paper type of a sheet, so paper B and paper C are compared with each other. Since both paper B and paper C have the paper size "A4" and paper type "plain paper", their circulating sheet counts and conveying speeds in double-sided printing are "5" and "constant speed", and coincide with each other. It is therefore determined that double-sided circulation can continue.

However, if double-sided circulation continues, as shown in FIG. 11, printing on a refeed surface 1102 of paper B having the conveying speed "half speed" is interposed between a feed surface (seventh document page) 1100 of paper D and a feed surface (ninth document page) 1101 of paper E having the conveying speed "constant speed".

This is applied to FIG. 7B showing five-sheet circulating conveyance control in double-sided printing. The sheet S4 corresponds to the obverse surface 1100 of paper D, the sheet S2 corresponds to the reverse surface 1102 of paper B, and the sheet S5 corresponds to the obverse surface 1101 of paper E. In this state, if the conveying speed of the refeed surface (fourth document page) (S2) of paper B changes to a half speed, paper E (S5) catches up with paper B (S2) because the conveying speed of the feed surface (ninth document page) (S5) of subsequent paper E is a constant speed. As a result, paper E and paper B collide against each other, generating a jam.

Figure 12:
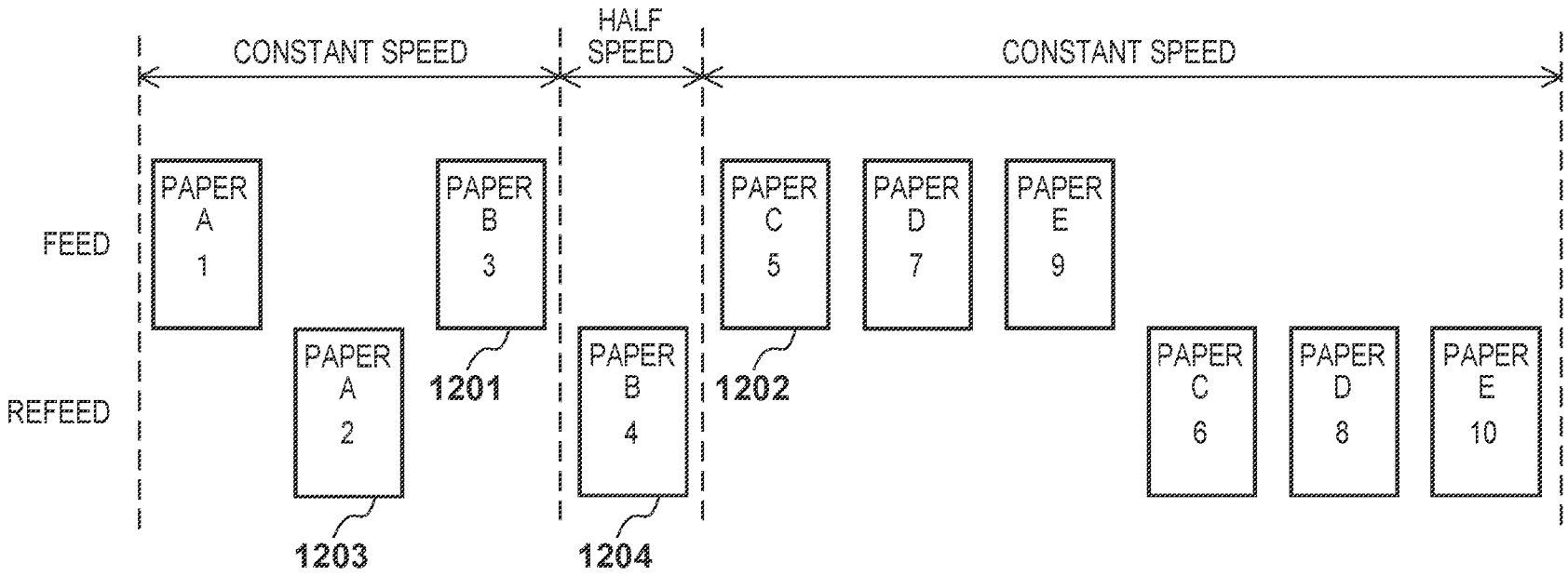
FIG. 12 is a view for explaining sheet conveyance control in the image forming apparatus according to the first embodiment.

FIG. 12 is a view for explaining sheet conveyance control in the image forming apparatus according to the first embodiment.

It is determined whether to continue double-sided circulation by feeding the feed surface (fifth document page) of paper C after feeding the feed surface (third document page) of paper B, or interrupt double-sided circulation by refeeding the refeed surface (second document page) of paper A and the refeed surface (fourth document page) of paper B. The control unit 110 makes this determination. In sheet conveyance control according to the first embodiment, the conveying speed is obtained not only based on the paper size and paper type of a sheet but also based on the resolution of the printing surface (conveying speed decision). That is, not only whether to perform double-sided circulation for each paper is determined, but also whether to continue or interrupt double-sided circulation is determined by comparing the conveying speeds of printing surfaces.

More specifically, a feed surface (fifth document page) 1202 of paper C and a feed surface (third document page) 1201 of paper B are compared with each other. Since both paper C and paper B have the paper size "A4" and paper type "plain paper", their double-sided circulating sheet counts are "5" in the table of FIG. 9 and coincide with each other. Also, the feed surface (fifth document page) 1202 of paper C and the feed surface (third document page) 1201 of paper B have the resolution "600 dpi". Hence, the conveying speeds of the feed surface (fifth document page) 1202 of paper C and the feed surface (third document page) 1201 of paper B are "constant speed" in the table of FIG. 9, and their double-sided circulating sheet counts and conveying speeds also coincide with each other.

Then, the feed surface (fifth document page) 1202 of paper C and a refeed surface (fourth document page) 1204 of paper B are compared with each other. Since both paper C and paper B have the paper size "A4" and paper type "plain paper", their double-sided circulating sheet counts are "5" in the table of FIG. 9 and coincide with each other. However, the resolution of the feed surface (fifth document page) 1202 of paper C is "600 dpi", and the conveying speed is "constant speed". In contrast, the resolution of the refeed surface (fourth document page) 1204 of paper B is 1,200 dpi, and the conveying speed is "half speed". Since the conveying speeds do not coincide with each other, it is determined not to continue double-sided circulation. Double-sided circulation is temporarily interrupted, all sheets (paper A and paper B) in the apparatus are discharged from the apparatus, and then paper C is fed.

Figure 13:
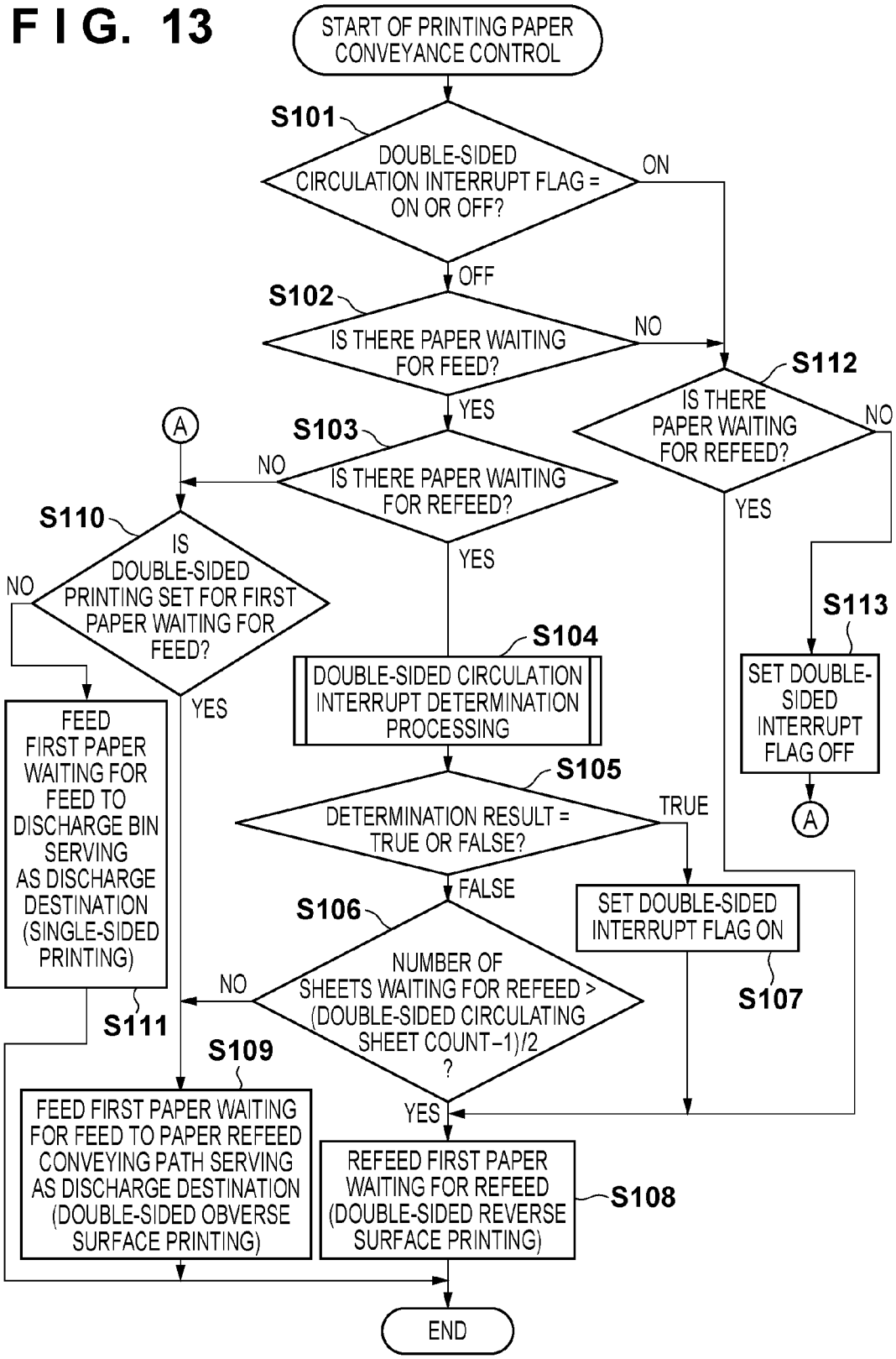
FIG. 13 is a flowchart for explaining sheet conveyance control processing by the control unit of the image forming apparatus according to the first embodiment.

FIG. 13 is a flowchart for explaining sheet conveyance control processing by the control unit 110 of the image forming apparatus according to the first embodiment. Note that a program which executes this processing is stored in the ROM 160, expanded in the RAM 150, and executed under the control of the CPU 120.

This processing starts when the control unit 110 starts sheet conveyance control. In step S101, the control unit 110 determines which of ON and OFF is set at a double-sided circulation interrupt flag in the RAM 150. If the double-sided circulation interrupt flag is ON, the process advances to step S112; if it is OFF, to step S102. In step S102, the control unit 110 checks whether there is paper (sheet) waiting for feed. If there is paper waiting for feed, the process advances to step S103; if there is no paper waiting for feed, to step S112.

In step S103, the control unit 110 determines whether there is paper waiting for refeed. If there is no paper waiting for refeed, the process advances to step S110; if there is paper waiting for refeed, to step S104. In step S110, the control unit 110 checks whether double-sided printing is set for the first paper waiting for feed. If single-sided printing is set, the process advances to step S111; if double-sided printing is set, to step S109. In step S111, the control unit 110 feeds the first paper waiting for feed to the discharge bin 350 serving as a discharge destination, ending the sheet conveyance control. If double-sided printing is set, the control unit 110 feeds the first paper waiting for feed to the paper refeed conveying path 332 serving as a discharge destination in step S109, ending the sheet conveyance control. The processes in steps S109 to S111 are general processes.

If there is paper waiting for refeed, the process advances to step S104, the control unit 110 performs double-sided circulation interrupt determination processing, and then the process advances to step S105. Details of double-sided circulation interrupt determination processing will be described with reference to the flowchart of FIG. 14.

In step S105, the control unit 110 determines the result of the double-sided circulation interrupt determination processing in step S104. If the result of the double-sided circulation interrupt determination processing is "FALSE", that is, the control unit 110 determines not to interrupt double-sided circulation, the process advances to step S106; if "TRUE" (interrupt), to step S107. In step S106, the control unit 110 determines whether the number of sheets waiting for refeed is larger than (double-sided circulating sheet count obtained from the table of FIG. 9−1)/2. For example, for a sheet having the paper size "A4" and paper type "plain paper", the double-sided circulating sheet count is "5" in FIG. 8B. In this case, (5−1)/2=2. If the number of sheets waiting for refeed is "1" or "2", the process advances from step S106 to step S109; if it is "3", from step S106 to step S108. In step S108, in order to print an image on the reverse surface of the first paper waiting for refeed, the control unit 110 refeeds the first paper to the discharge bin 350 serving as a discharge destination, ending the sheet conveyance control. If the control unit 110 determines in step S105 to interrupt double-sided circulation, the process advances to step S107, the control unit 110 sets the double-sided circulation interrupt flag ON in the RAM 150, and the process advances to step S108.

If the double-sided circulation interrupt flag is ON in step S101 or there is no paper waiting for feed in step S102, the process advances to step S112, and the control unit 110 determines whether there is paper waiting for refeed. If the control unit 110 determines that there is paper waiting for refeed, the process advances to step S108. If the control unit 110 determines that there is no paper waiting for refeed, the process advances to step S113, and the control unit 110 sets the double-sided circulation interrupt flag OFF in the RAM 150, ending the sheet conveyance control.

By the above processing, paper feed can be controlled by determining not only whether to perform double-sided circulation for each paper, but also determining whether to continue or interrupt double-sided circulation, by comparing the conveying speeds of printing surfaces, as described with reference to FIG. 12.

Figure 14:
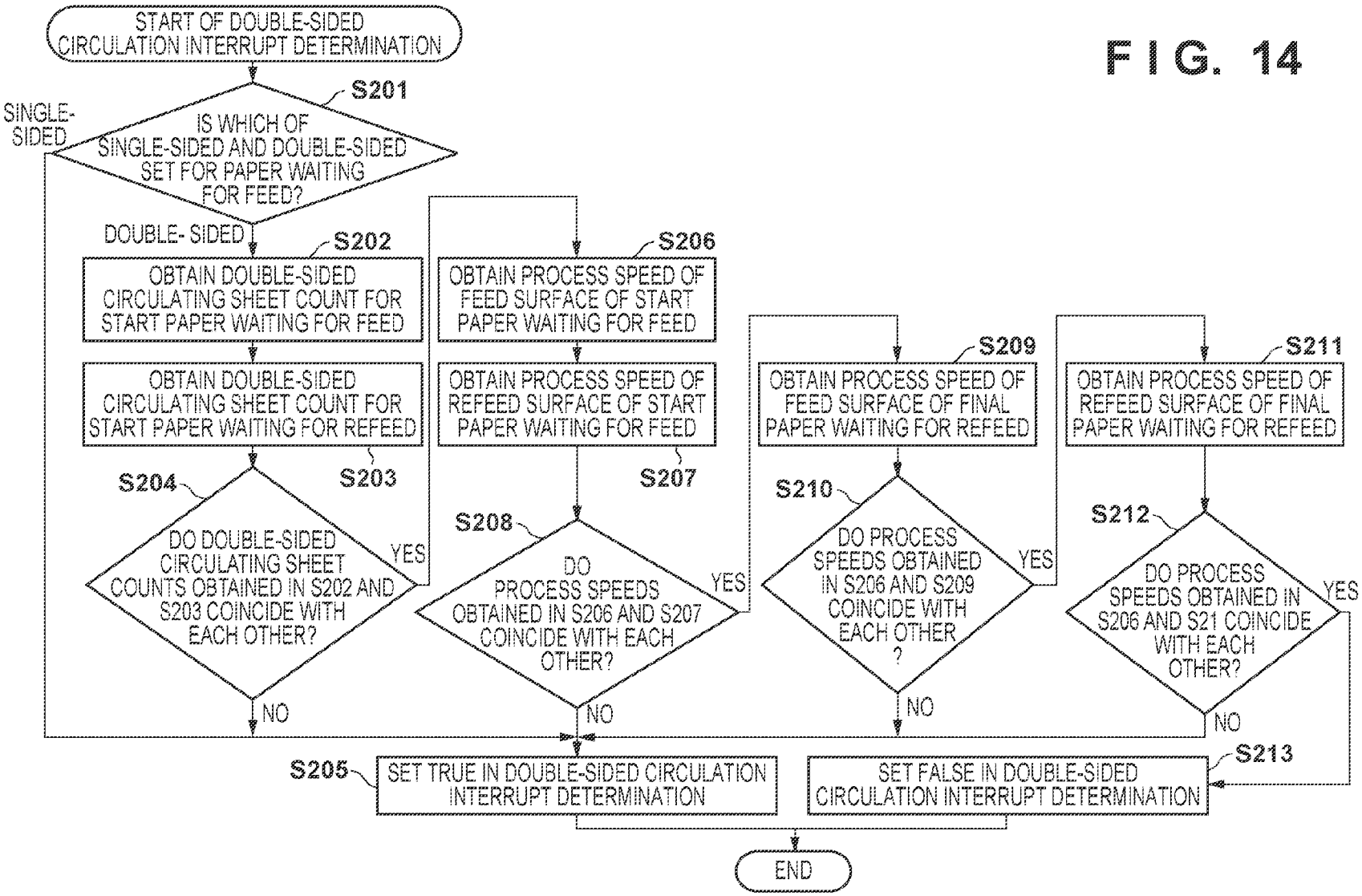
FIG. 14 is a flowchart for explaining processing of determining whether to interrupt double-sided circulation in step S104 of FIG. 13.

FIG. 14 is a flowchart for explaining processing of determining whether to interrupt double-sided circulation in step S104 of FIG. 13.

This processing starts when the control unit 110 starts processing of determining whether to interrupt double-sided circulation. In step S201, the control unit 110 determines which of single-sided printing and double-sided printing is set for paper waiting for feed. If single-sided printing is set, the process advances to step S205, and the control unit 110 decides TRUE (to interrupt double-sided circulation) in double-sided circulation interrupt determination, ending the determination processing.

If the control unit 110 determines in step S201 that double-sided printing is set, the process advances to step S202, and the control unit 110 obtains a double-sided circulating sheet count by looking up the table of FIG. 9 based on the paper size and paper type of the first paper waiting for feed. The process then advances to step S203. In step S203, the control unit 110 obtains a double-sided circulating sheet count by looking up the table of FIG. 9 based on the paper size and paper type of the final paper waiting for refeed. The process then advances to step S204. In step S204, the control unit 110 determines whether the double-sided circulating sheet counts obtained in steps S202 and S203 coincide with each other. If the control unit 110 determines that the double-sided circulating sheet counts do not coincide with each other, the process advances to step S205, and the control unit 110 decides to interrupt double-sided circulation, ending the processing.

If the control unit 110 determines in step S204 that the double-sided circulating sheet counts coincide with each other, the process advances to step S206, and the control unit 110 obtains a conveying speed by looking up the table of FIG. 9 based on the paper size, paper type, and resolution of the feed surface of the first paper waiting for feed. Then, the process advances to step S207. In step S207, the control unit 110 obtains a conveying speed by looking up the table of FIG. 9 based on the paper size, paper type, and resolution of the refeed surface of the first paper waiting for feed. Thereafter, the process advances to step S208. In step S208 (first determination), the control unit 110 determines whether the conveying speeds obtained in steps S206 and S207 coincide with each other. If the control unit 110 determines that the conveying speeds do not coincide with each other, the process advances to step S205, and the control unit 110 decides to interrupt double-sided circulation, ending the processing.

If the control unit 110 determines in step S208 that the conveying speeds coincide with each other, the process advances to step S209, and the control unit 110 obtains a conveying speed by looking up the table of FIG. 9 based on the paper size, paper type, and resolution of the feed surface of the final paper waiting for refeed. Then, the process advances to step S210. In step S210 (second determination), the control unit 110 determines whether the conveying speeds obtained in steps S206 and S209 coincide with each other. If the conveying speeds coincide with each other, the process advances to step S211. If the conveying speeds do not coincide with each other, the process advances to step S205, and the control unit 110 decides to interrupt double-sided circulation, ending the processing.

In step S211, the control unit 110 obtains a conveying speed by looking up the table of FIG. 9 based on the paper size, paper type, and resolution of the refeed surface of the final paper waiting for refeed. The process then advances to step S212. In step S212 (third determination), the control unit 110 determines whether the conveying speeds obtained in steps S206 and S211 coincide with each other. If the conveying speeds coincide with each other, the process advances to step S213, and the control unit 110 decides FALSE (not to interrupt double-sided circulation) in double-sided circulation interrupt determination, ending the processing. If the control unit 110 determines in step S212 that the conveying speeds obtained in steps S206 and S211 do not coincide with each other, the process advances to step S205, and the control unit 110 decides to interrupt double-sided circulation, ending the processing.

In the above-described determination processing, it is decided to interrupt double-sided circulation when one of the following three conditions is not satisfied based on the paper size, paper type, and resolution:

(1) whether the process speed of the feed surface of the first paper waiting for feed and that of the refeed surface of the first paper waiting for feed coincide with each other, (2) whether the process speed of the feed surface of the first paper waiting for feed and that of the feed surface of the final paper waiting for refeed coincide with each other, and (3) whether the process speed of the feed surface of the first paper waiting for feed and that of the refeed surface of the final paper waiting for refeed coincide with each other.

A sheet conveyance control method by the image forming apparatus according to the first embodiment will be explained with reference to FIGS. 13, 14, 15, and 16.

Figure 15:
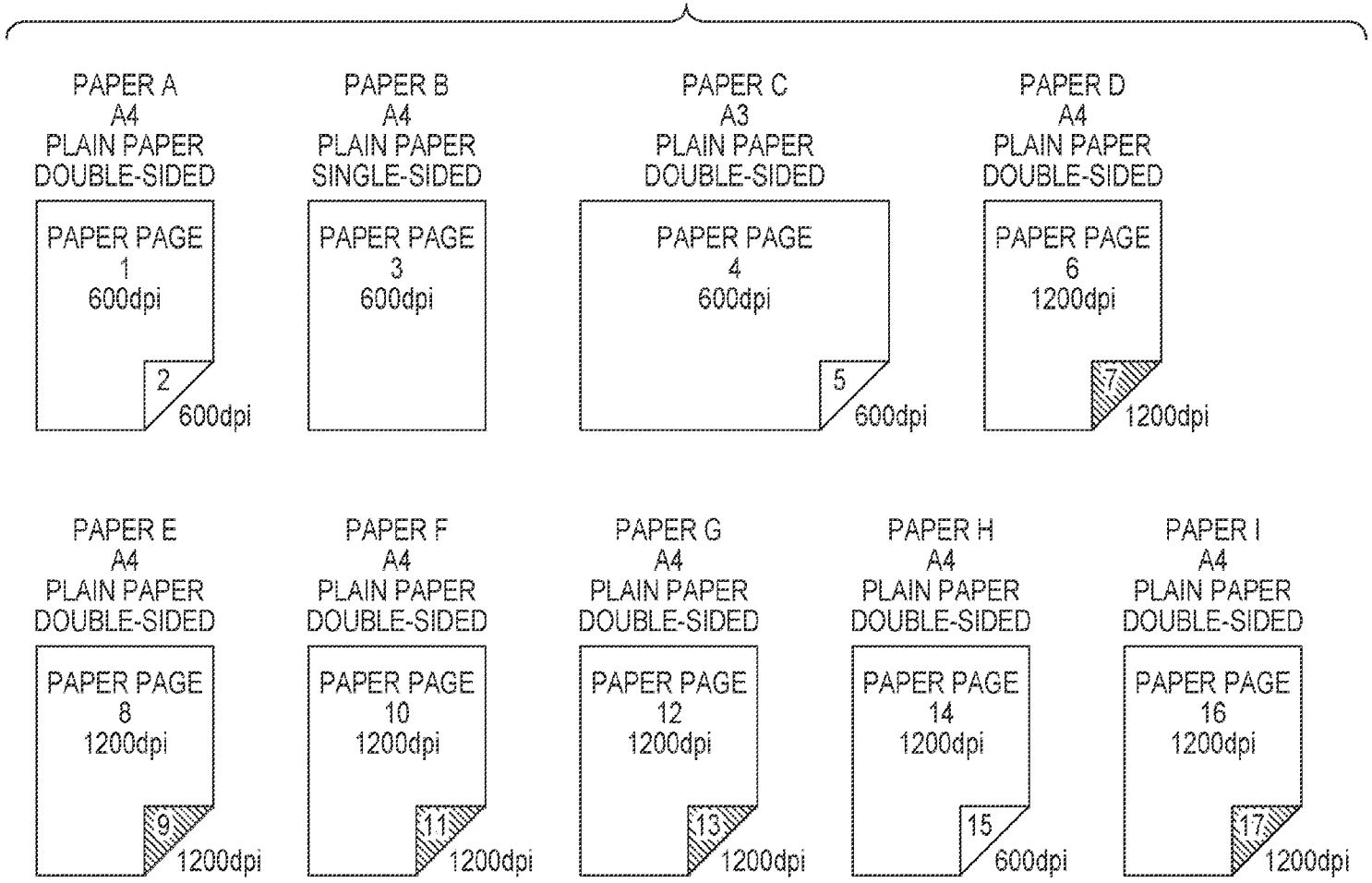
FIG. 15 is a view exemplifying paper (sheet) output from the image forming apparatus according to the first embodiment.

FIG. 15 is a view exemplifying paper (sheet) output from the image forming apparatus according to the first embodiment. There are paper A to paper I, that is, a total of nine sheets. As for single-sided printing and double-sided printing, single-sided printing is set for only paper B, and double-sided printing is set for all the remaining paper sheets. The paper size is A3 for only paper C, and A4 for all the remaining paper sheets. The paper type is plain paper for all the paper sheets. The resolution is 600 dpi for 1 to 5 pages of the document, 1,200 dpi for 6 to 14 pages, 600 dpi for 15 page, and 1,200 dpi for 16 and 17 pages. A printing surface having the 1,200 dpi-resolution is hatched.

Figure 16:
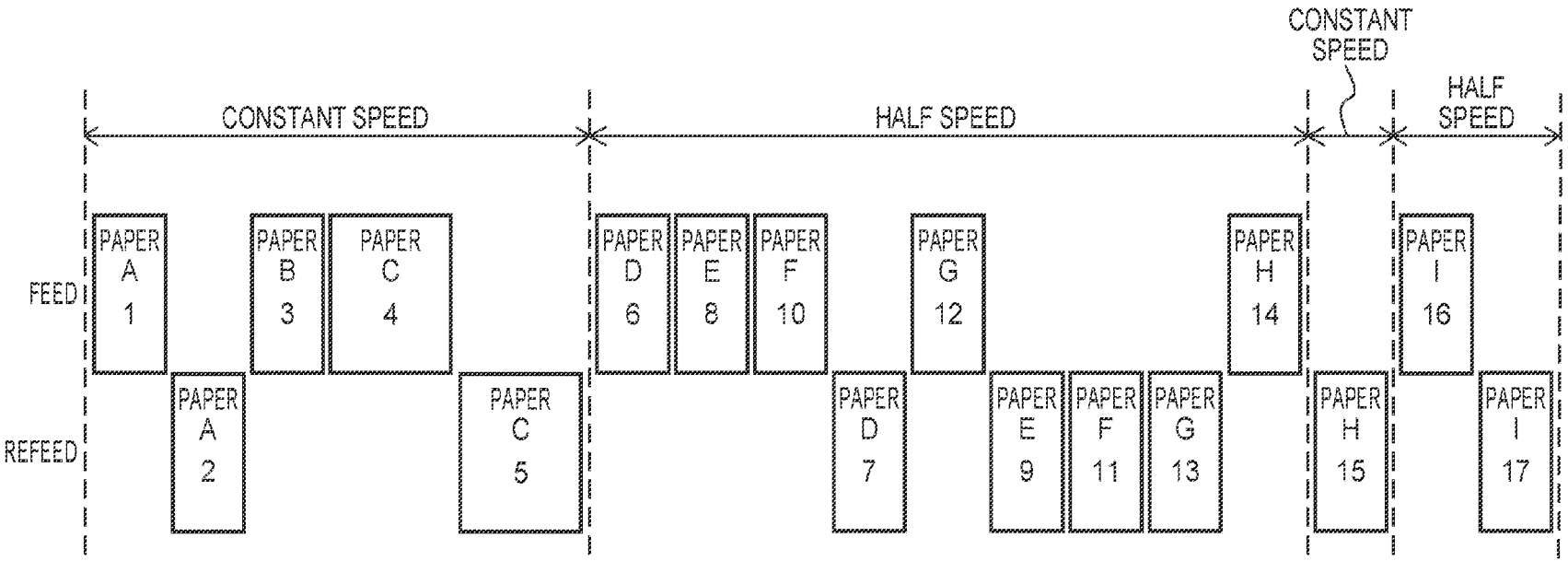
FIG. 16 is a view for explaining the order of paper sheets to be fed and refed in the image forming apparatus according to the first embodiment.

FIG. 16 is a view for explaining the order of paper sheets to be fed and refed in the image forming apparatus according to the first embodiment.

First, when feeding paper A, the control unit 110 advances to steps S101, S102, S103, S110, and S109 of FIG. 13, and feeds paper A serving as the first paper waiting for feed to the paper refeed conveying path 332 serving as a discharge destination, ending the sheet conveyance control. When feeding paper B, the control unit 110 advances to step S101, S102, S103, and S104 of FIG. 13, and performs double-sided circulation interrupt determination processing.

In double-sided circulation interrupt processing, the control unit 110 advances to step S201 of FIG. 14. Since single-sided printing is set for paper B waiting for feed, the control unit 110 advances to step S205, and decides TRUE (to interrupt double-sided circulation) in double-sided circulation interrupt determination. After that, the control unit 110 advances to steps S105, S107, and S108 of FIG. 13, and refeeds paper A serving as the first paper waiting for refeed to the discharge bin 350 serving as a discharge destination, ending the sheet conveyance control.

Again, when feeding paper B, the control unit 110 advances to step S101, S102, S103, S110, and S111 of FIG. 13, and feeds paper B serving as the first paper waiting for feed to the discharge bin 350 serving as a discharge destination, ending the sheet conveyance control.

When feeding paper C, the control unit 110 advances to step S101, S102, S103, S110, and S109 of FIG. 13, and feeds paper C serving as the first paper waiting for feed to the paper refeed conveying path 332 serving as a discharge destination, ending the sheet conveyance control.

When feeding paper D, the control unit 110 advances to step S101, S102, S103, and S104 of FIG. 13, and performs double-sided circulation interrupt determination processing. In double-sided circulation interrupt processing, the control unit 110 advances to step S201 of FIG. 14. Since double-sided printing is set for paper D waiting for feed, the control unit 110 advances to steps S202, S203, and S204. Paper C has the size "A3" and type "plain paper", so the double-sided circulating sheet count is "3". Paper D has the size "A4" and "plain paper", so the double-sided circulating sheet count is "5". As a result, the double-sided circulating sheet counts of paper C and paper D do not coincide with each other in step S204, and the control unit 110 advances to step S205 and decides TRUE in double-sided circulation interrupt determination. Then, the control unit 110 advances to steps S105, S107, and S108 of FIG. 13, and refeeds paper C serving as the first paper waiting for refeed to the discharge bin 350 serving as a discharge destination, ending the sheet conveyance control.

Again, when feeding paper D, the control unit 110 advances to step S101, S102, S103, S110, and S109 of FIG. 13, and feeds, to the paper refeed conveying path 332 serving as a discharge destination, paper D to undergo double-sided printing which is the first paper waiting for feed, ending the sheet conveyance control. When feeding paper E, the control unit 110 advances to step S101, S102, S103, and S104 of FIG. 13, and determines whether to interrupt double-sided circulation. In the determination processing, the control unit 110 advances to step S201 of FIG. 14. Since double-sided printing is set for paper F serving as paper waiting for feed, the control unit 110 advances to step S202. The control unit 110 then advances to steps S203 and S204. Both paper D and paper E commonly have the size "A4" and "plain paper", and their double-sided circulating sheet counts are "5" in FIG. 9 and coincide with each other. Thus, the control unit 110 advances to step S206. The control unit 110 further advances to steps S207 and S208, and compares the conveying speed of the feed surface (eighth document page) of paper E and that of the refeed surface (ninth document page) of paper E. Both the feed surface of paper E and the refeed surface of paper E commonly have the size "A4", "plain paper", and resolution "1200 dpi", and their conveying speeds are "half speed" in FIG. 9 and coincide with each other. Thus, the control unit 110 advances to step S209. In step S209, both the feed surface (eighth document page) of paper E and the feed surface (sixth document page) of paper D commonly have "A4", "plain paper", and "1200 dpi", and their conveying speeds are "half speed" in FIG. 9. Thus, the control unit 110 advances to step S211.

Further, both the feed surface (eighth document page) of paper E and the refeed surface (seventh document page) of paper D commonly have "A4", "plain paper", and "1200 dpi", and their conveying speeds are "half speed" in FIG. 9. Thus, the control unit 110 advances from S212 to S213, and decides FALSE in double-sided circulation interrupt determination. After that, the control unit 110 advances to steps S105, S106, and S109 of FIG. 13, and feeds paper E serving as the first paper waiting for feed to the paper refeed conveying path 332 serving as a discharge destination for double-sided printing, ending the sheet conveyance control.

When feeding paper F, the control unit 110 advances to step S101, S102, S103, and S104 of FIG. 13, and determines whether to interrupt double-sided circulation, similar to paper E. In this determination processing, the control unit 110 advances to step S201 of FIG. 14. Since double-sided printing is set for paper F serving as paper waiting for feed, the control unit 110 advances to step S202. The control unit 110 then advances to steps S203 and S204. Both paper E and paper F have "A4" and "plain paper", and their double-sided circulating sheet counts are "5" in FIG. 9. Thus, the control unit 110 advances to step S206. In steps S207 and S208, the control unit 110 compares the conveying speed of the feed surface (10th document page) of paper F and that of the refeed surface (11th document page) of paper F. Both the feed surface of paper F and the refeed surface of paper F have "A4", "plain paper", and "1200 dpi", and their conveying speeds are "half speed" in FIG. 9. Thus, the control unit 110 advances to step S209. Also, both the feed surface (10th document page) of paper F and the feed surface (eighth document page) of paper E have "A4", "plain paper", and "1200 dpi", and their conveying speeds are "half speed" and coincide with each other. Thus, the control unit 110 advances to step S211.

Further, the control unit 110 compares the conveying speed of the feed surface (10th document page) of paper F and that of the refeed surface (ninth document page) of paper E. Both the feed surface of paper F and the refeed surface of paper E have "A4", "plain paper", and "1200 dpi", and their conveying speeds are "half speed" in FIG. 9. Thus, the control unit 110 advances to step S213, and determines not to interrupt double-sided circulation. The control unit 110 then advances to steps S105, S106, and S109 of FIG. 13, and feeds paper F serving as the first paper waiting for feed to the paper refeed conveying path 332 serving as a discharge destination for double-sided printing, ending the sheet conveyance control.

When feeding paper G, the control unit 110 advances to step S101, S102, S103, and S104 of FIG. 13, and determines whether to interrupt double-sided circulation. In this processing, the control unit 110 advances to step S201 of FIG. 14. Since double-sided printing is set for paper G serving as paper waiting for feed, the control unit 110 advances to step S202. The control unit 110 then advances to steps S203 and S204. Both paper F and paper G have "A4" and "plain paper", and their double-sided circulating sheet counts are "5" in FIG. 9. Thus, the control unit 110 advances to step S206. The control unit 110 further advances to steps S207 and S208, and compares the conveying speed of the feed surface (12th document page) of paper G and that of the refeed surface (13th document page) of paper G. Both the feed surface of paper G and the refeed surface of paper G have "A4", "plain paper", and "1200 dpi", and their conveying speeds are "half speed". Thus, the control unit 110 advances to step S209. Further, both the feed surface (12th document page) of paper G and the feed surface (10th document page) of paper F have "A4", "plain paper", and "1200 dpi", and their conveying speeds are "half speed". Thus, the control unit 110 advances to step S211. The control unit 110 further advances to step S212, and compares the conveying speed of the feed surface (12th document page) of paper G and that of the refeed surface (11th document page) of paper F. Both the feed surface of paper G and the refeed surface of paper F have "A4", "plain paper", and "1200 dpi", and their conveying speeds are "half speed". Thus, the control unit 110 advances to step S213, and decides not to interrupt double-sided circulation. Thereafter, the control unit 110 advances to steps S105 and S106 of FIG. 13. In step S106, three, paper D, paper E, and paper F already exist as paper waiting for refeed, and the number of sheets waiting for refeed is larger than (double-sided circulating sheet count "5"−1)÷2=2. The control unit 110 therefore advances to step S108, and refeeds paper D serving as the first paper waiting for refeed, ending the sheet conveyance control.

Again, when feeding paper G, the control unit 110 advances to step S101, S102, S103, and S104 of FIG. 13, and determines whether to interrupt double-sided circulation. In this processing, the control unit 110 advances to step S201 of FIG. 14. Since double-sided printing is set for paper G serving as paper waiting for feed, the control unit 110 advances to step S202. The control unit 110 then advances to steps S203 and S204. Both paper F and paper G have "A4" and "plain paper", and their double-sided circulating sheet counts are "5". Thus, the control unit 110 advances to step S206. The control unit 110 further advances to steps S207 and S208, and compares the conveying speed of the feed surface (12th document page) of paper G and that of the refeed surface (13th document page) of paper G. Both the feed surface of paper G and the refeed surface of paper G have "A4", "plain paper", and "1200 dpi", and their conveying speeds are "half speed". Thus, the control unit 110 advances to step S209. Further, both the feed surface (12th document page) of paper G and the feed surface (10th document page) of paper F have "A4", "plain paper", and "1200 dpi", and their conveying speeds are "half speed". Thus, the control unit 110 advances to step S211. The control unit 110 then advances to step S212, and compares the conveying speed of the feed surface (12th document page) of paper G and that of the refeed surface (11th document page) of paper F. Both the feed surface of paper G and the refeed surface of paper F have "A4", "plain paper", and "1200 dpi", and their conveying speeds are "half speed". Thus, the control unit 110 advances to step S213, and determines not to interrupt double-sided circulation.

Thereafter, the control unit 110 advances to steps S105 and S106 of FIG. 13. In step S106, two, paper E and paper F already exist as paper waiting for refeed, but the number of sheets waiting for refeed is not larger than (double-sided circulating sheet count "5"−1)÷2=2. Hence, the control unit 110 advances to step S109. In step S109, the control unit 110 feeds paper G serving as the first paper waiting for feed to the paper refeed conveying path 332 serving as a discharge destination for double-sided printing, ending the sheet conveyance control.

Next, a case in which paper H is fed will be explained. The control unit 110 advances to steps S101, S102, S103, and S104 of FIG. 13, and determines whether to interrupt double-sided circulation. In this processing, the control unit 110 advances to step S201 of FIG. 14. Since double-sided printing is set for paper H serving as paper waiting for feed, the control unit 110 advances to step S202. The control unit 110 then advances to steps S203 and S204. Both paper G and paper H have "A4" and "plain paper", and their double-sided circulating sheet counts are "5". Thus, the control unit 110 advances to step S206. The control unit 110 further advances to steps S207 and S208. The feed surface (14th document page) of paper H has "A4", "plain paper", and "1200 dpi", and its conveying speed is "half speed". In contrast, the refeed surface (15th document page) of paper H has "A4", "plain paper", and "600 dpi", and its conveying speed is "constant speed". These conveying speeds do not coincide with each other. For this reason, the control unit 110 advances to step S205, and decides to interrupt double-sided circulation. The control unit 110 then advances to steps S105, S107, and S108 of FIG. 13, and refeeds paper E serving as the first paper waiting for refeed to the discharge bin 350 serving as a discharge destination, ending the sheet conveyance control. That is, the double-sided printing of paper E is not executed continuously.

The control unit 110 determines which of paper H waiting for feed is to be fed or paper F waiting for refeed is to be refed. At this time, the double-sided circulation interrupt flag has been ON in step S107 in the previous paper feed determination for paper H. Hence, the control unit 110 advances from step S101 to steps S112 and S108. In step S108, the control unit 110 refeeds paper F serving as the first paper waiting for refeed to the discharge bin 350 serving as a discharge destination, ending the sheet conveyance control.

After that, the control unit 110 determines which of paper H waiting for feed is to be fed or paper G waiting for refeed is to be refed. At this time, the double-sided circulation interrupt flag has been ON in step S107 in the previous paper feed determination for paper H. The control unit 110 therefore advances from step S101 to steps S112 and S108 in FIG. 13. In step S108, the control unit 110 refeeds paper G serving as the first paper waiting for refeed to the discharge bin 350 serving as a discharge destination, ending the sheet conveyance control.

When feeding paper H, the double-sided circulation interrupt flag has been ON in step S107 in the previous paper feed determination for paper H. Thus, the control unit 110 advances from step S101 to step S112. In step S112, paper F and paper G waiting for refeed have already been refed, so there is no paper waiting for refeed. The control unit 110 advances to step S113, and sets the double-sided circulation interrupt flag OFF. The control unit 110 advances to steps S110 and S109, and feeds paper H serving as the first paper waiting for feed to the paper refeed conveying path 332 serving as a discharge destination for double-sided printing, ending the sheet conveyance control.

When feeding paper I, the control unit 110 advances to steps S101, S102, S103, and S104 of FIG. 13, and determines whether to interrupt double-sided circulation. The control unit 110 then advances to steps S203 and S204 of FIG. 14. Both paper H and paper I have "A4" and "plain paper", and their double-sided circulating sheet counts are "5". Thus, the control unit 110 advances to step S206. The control unit 110 further advances to steps S207 and S208, and compares the conveying speed of the feed surface (16th document page) of paper I and that of the refeed surface (17th document page) of paper I. Both the feed surface of paper I and the refeed surface of paper I commonly have "A4", "plain paper", and "1200 dpi", and their conveying speeds are "half speed". Thus, the control unit 110 advances to step S209. Both the feed surface (16th document page) of paper I and the feed surface (14th document page) of paper H have "A4", "plain paper", and "1200 dpi", and their conveying speeds are "half speed". Thus, the control unit 110 advances to step S211. The control unit 110 further advances to step S212. The feed surface (16th document page) of paper I has "A4", "plain paper", and "1200 dpi", and its conveying speed is "half speed". To the contrary, the refeed surface (15th document page) of paper H has "A4", "plain paper", and "600 dpi", and its conveying speed is "constant speed". These conveying speeds do not coincide with each other. For this reason, the control unit 110 advances to step S205, and determines to interrupt double-sided circulation. The control unit 110 then advances to steps S105, S107, and S108 of FIG. 13, and refeeds paper H serving as the first paper waiting for refeed to the discharge bin 350 serving as a discharge destination, ending the sheet conveyance control.

Again, when feeding paper I, the control unit 110 advances to step S101, S102, S103, S110, and S109 of FIG. 13, and feeds paper I serving as the first paper waiting for feed to the paper refeed conveying path 332 serving as a discharge destination, ending the sheet conveyance control. When finally refeeding paper I, the control unit 110 advances to step S101, S102, S112, and S108 of FIG. 13, and refeeds paper I serving as the first paper waiting for refeed to the discharge bin 350 serving as a discharge destination, ending the sheet conveyance control.

The above-described feed & refeed order is shown in FIG. 16.

In the above-described method according to the first embodiment, when determining whether to continue double-sided circulation, it is determined whether the resolutions of the feed and refeed surfaces of paper (printing medium) to be fed next are different from each other, or whether the resolution of the feed surface of paper to be fed next and that of the feed surface of immediately previously fed paper are different from each other. Further, it is determined whether the resolution of the feed surface of paper to be fed next and that of the refeed surface of immediately previously fed paper are different from each other. If the resolutions differ from each other in one of these conditions, it is determined to interrupt double-sided circulation. Accordingly, double-sided printing can be executed efficiently.

Second Embodiment

The second embodiment of the present invention will be described with reference to FIGS. 17, 18, and 19. Note that an image forming apparatus (multi-function peripheral) and image input/output system according to the second embodiment have the same arrangements as those in the first embodiment, and a description thereof will not be repeated.

Figure 17:
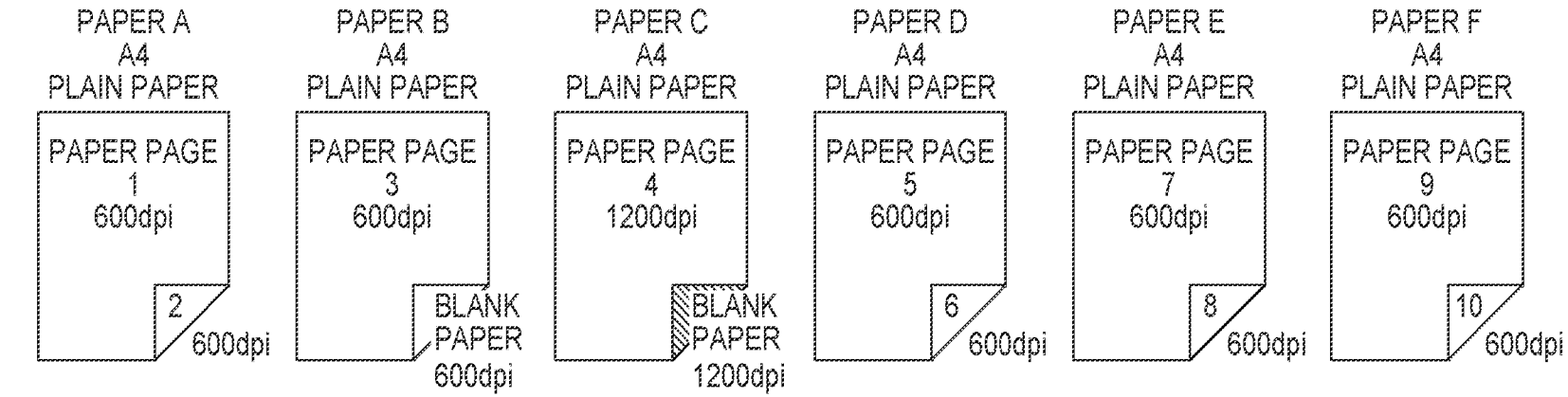
FIG. 17 is a view exemplifying double-sided imposition in the second embodiment.

FIG. 17 is a view exemplifying double-sided imposition in the second embodiment. More specifically, a document is formed from 10 pages. The resolution is basically 600 dpi, but 1,200 dpi only for the fourth document page.

All paper A to paper F have the paper size "A4" and paper type "plain paper". The resolution is basically 600 dpi, but 1,200 dpi for only the feed surface (fourth document page) and refeed surface (blank surface) of paper C. Note that a 1200-dpi printing surface is hatched.

The 1200-dpi fourth document page is laid out on the reverse surface of paper B in FIG. 10 according to the first embodiment, but laid out on the obverse surface of paper C in double-sided imposition according to the second embodiment. Blank pages having the same resolutions as those of the obverse surfaces of paper B and paper C correspond to the reverse surfaces of paper B and paper C. In double-sided imposition according to the second embodiment, planes having different resolutions are not laid out on the obverse and reverse surfaces in double-sided printing, so the conveying speed is not switched between the obverse and reverse surfaces. Therefore, conventional double-sided circulation control for each paper as shown in FIG. 18 can be implemented, preventing a problem such as generation of a jam.

Figure 18:
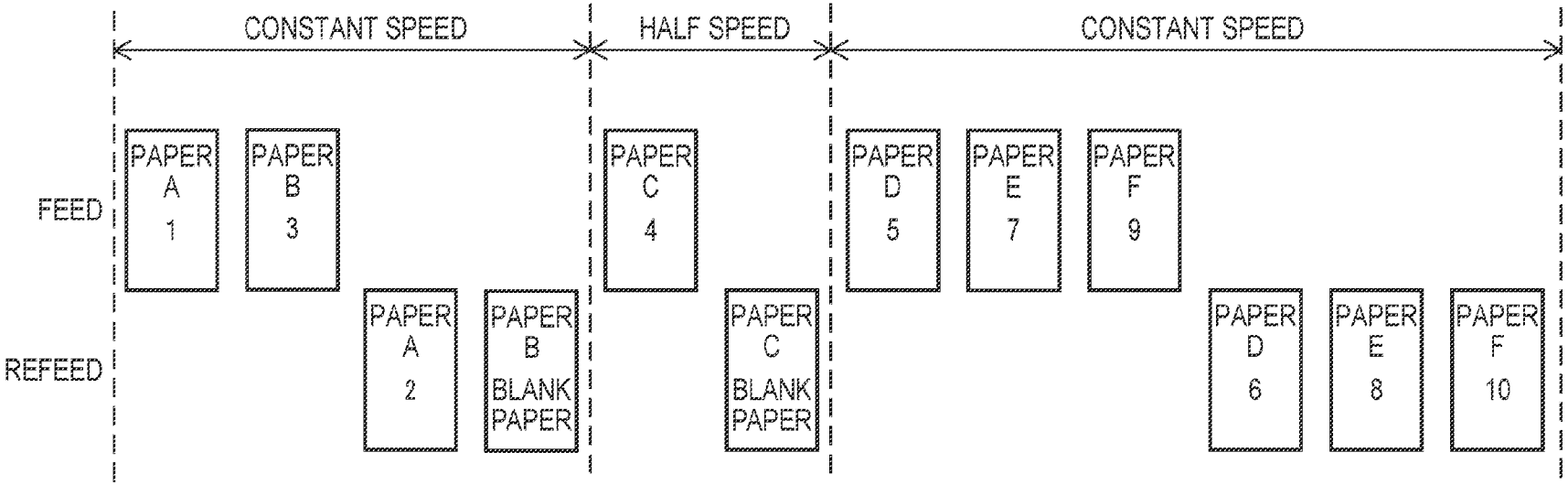
FIG. 18 is a view for explaining the order of paper sheets to be fed and refed in an image forming apparatus according to the second embodiment.

FIG. 18 is a view for explaining the order of paper sheets to be fed and refed in an image forming apparatus according to the second embodiment.

Figure 19:
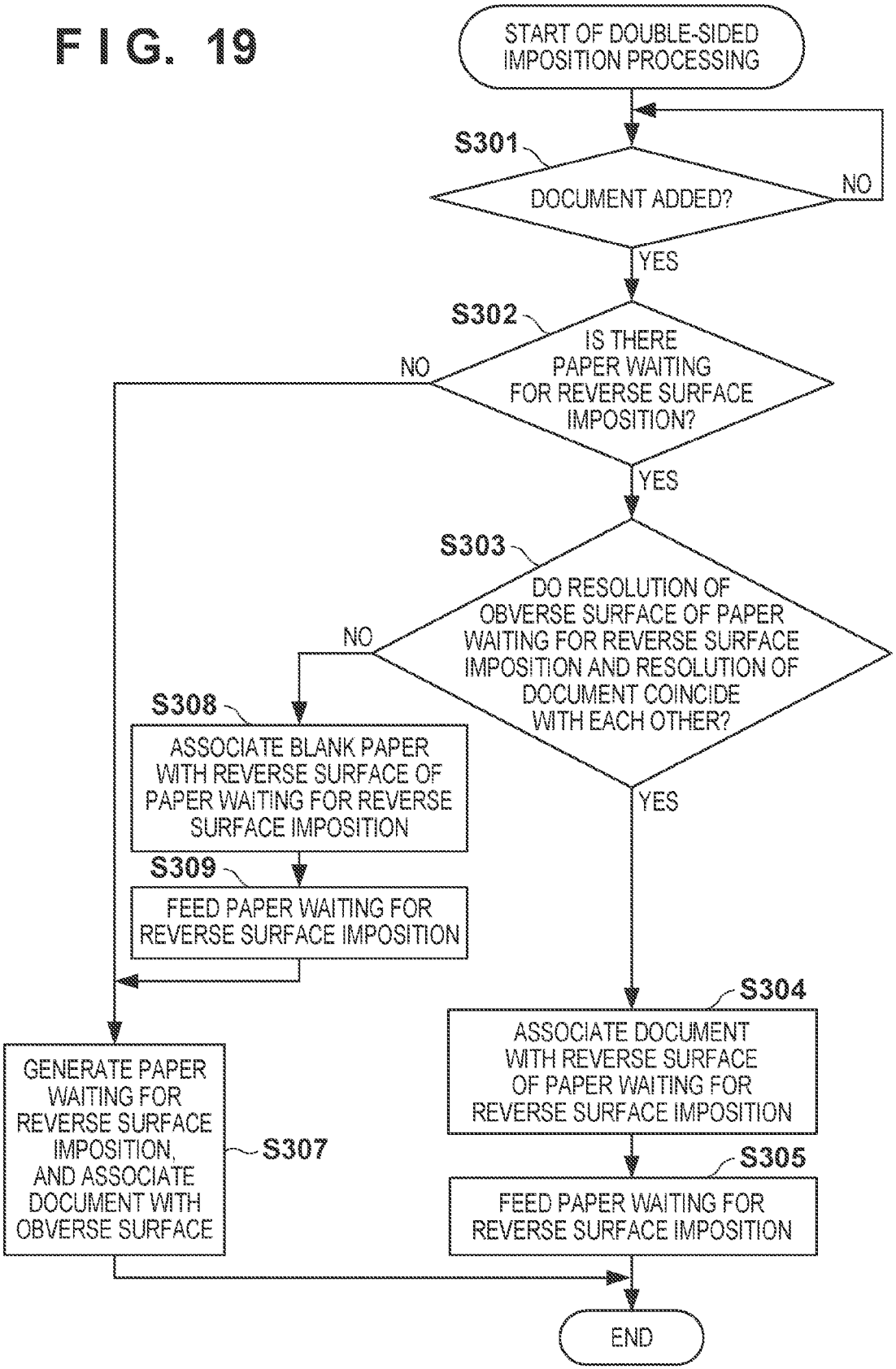
FIG. 19 is a flowchart for explaining double-sided imposition processing by the control unit of the image forming apparatus according to the second embodiment.

FIG. 19 is a flowchart for explaining double-sided imposition processing by a control unit 110 of the image forming apparatus according to the second embodiment of the present invention. Note that a program which executes this processing is stored in a ROM 160, expanded in a RAM 150, and executed under the control of a CPU 120.

This processing starts when the control unit 110 starts double-sided imposition processing. In step S301, the control unit 110 confirms whether a document has been added. If a document to be printed has been added, the process advances to step S302; if NO, returns to step S301 to wait until the next document is added. In step S302, the control unit 110 determines whether there is paper waiting for reverse surface imposition. If the control unit 110 determines that there is paper waiting for reverse surface imposition, the process advances to step S303. If NO in step S302, the process advances to step S307, and the control unit 110 newly generates paper waiting for reverse surface imposition, and associates the document with the obverse surface of the paper, ending the double-sided imposition processing.

In step S303, the control unit 110 determines whether the resolution of the obverse surface of paper waiting for reverse surface imposition and the resolution of the document coincide with each other. If the control unit 110 determines that the resolutions coincide with each other, the process advances to step S304, the control unit 110 associates the document with the reverse surface of paper waiting for reverse surface imposition, and the process advances to step S305. In step S305, the control unit 110 feeds the paper waiting for reverse surface imposition, ending the double-sided imposition processing.

If the control unit 110 determines in step S303 that the resolutions do not coincide with each other, the process advances to step S308, and the control unit 110 associates blank paper with the reverse surface of paper waiting for reverse surface imposition. The control unit 110 inserts the blank paper and performs imposition so that the resolutions of the obverse and reverse surfaces coincide with each other. Then, the process advances to step S309. In step S309, the control unit 110 feeds the paper which has the reverse surface associated with the blank paper in step S308 and waits for reverse surface imposition. After that, the process advances to step S307. In step S307, the control unit 110 newly generates paper waiting for reverse surface imposition, and associates the document with the obverse surface, ending the double-sided imposition processing.

As described above, according to the second embodiment, the resolutions of the feed and refeed surfaces of paper (printing medium) to be fed next always coincide with each other. Conveyance control suitable for even double-sided circulation control for each paper can be executed.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-193275 filed on Sep. 5, 2011, which is hereby incorporated by reference herein in its entirety.

What is claimed is:

1. An image forming apparatus arranged to perform image formation on the surfaces of a double-sided sheet by image forming on a first surface of a fed sheet, re-feeding the sheet, and image forming on a second surface of the sheet, the image forming apparatus comprising:

an image forming unit configured to form images on the sheet;

a feeding unit configured to feed the sheet to the image forming unit, invert the sheet, and re-feed the inverted sheet to the image forming unit; and a control unit in communication with the image forming unit and the feeding unit, the control unit configured to control the feeding unit to feed a subsequent sheet to the image forming unit before a previous sheet inverted by the feeding unit is fed to the image forming unit in a case where a resolution of the image to be formed on the subsequent sheet corresponds to a resolution of the image formed on the previous sheet, and to feed the previous sheet inverted by the feeding unit to the image forming unit before the subsequent sheet is fed to the image forming unit in a case where the resolution of the image to be formed on the subsequent sheet does not correspond to the resolution of the image formed on the previous sheet.

2. The apparatus according to claim 1, wherein the resolution of the image formed on the previous sheet is a resolution of an image formed on a first surface of the previous sheet, and the resolution of the image to be formed on the subsequent sheet is a resolution of an image formed on a first surface of the subsequent sheet.

3. The apparatus according to claim 1, wherein the control unit controls the feeding unit to feed the subsequent sheet to the image forming unit before the previous sheet inverted by the feeding unit is fed to the image forming unit in a case where a resolution of the image to be formed on a first surface of the subsequent sheet corresponds to a resolution of the image formed on a second surface of the subsequent sheet, and to feed the previous sheet inverted by the feeding unit to the image forming unit before the subsequent sheet is fed to the image forming unit in a case where the resolution of the image to be formed on the first surface of the subsequent sheet does not correspond to the resolution of the image formed on the second surface of the subsequent sheet.

4. The apparatus according to claim 1, wherein the resolution of the image formed on the previous sheet is a resolution of an image formed on a second surface of the previous sheet, and the resolution of the image to be formed on the subsequent sheet is a resolution of an image to be formed on a first surface of the subsequent sheet.

5. The apparatus according to claim 1, wherein the control unit controls the feeding unit to feed the previous sheet inverted by the feeding unit to the image forming unit before the subsequent sheet is fed to the image forming unit in a case where the subsequent sheet is a sheet of a target in a single-sided printing.

6. The apparatus according to claim 5, wherein the control unit determines a number of sheets being capable of being circulated to a circulating path based on a size and a type of the previous sheet.

7. A method of an image forming apparatus arranged to perform image formation on the surfaces of a double-sided sheet by image forming on a first surface of a fed sheet, re-feeding the sheet, and image forming on a second surface of the sheet, the method comprising:

feeding the sheet to an image forming unit arranged to form images on the sheet;

inverting the sheet;

re-feeding the inverted sheet to the image forming unit; and controlling to feed a subsequent sheet to the image forming unit before an inverted previous sheet is fed to the image forming unit in a case where a resolution of the image to be formed on the subsequent sheet corresponds to a resolution of the image formed on the previous sheet, and to feed the inverted previous sheet to the image forming unit before the subsequent sheet is fed to the image forming unit in a case where the resolution of the image to be formed on the subsequent sheet does not correspond to the resolution of the image to be formed on the previous sheet.

8. A non-transitory computer-readable storage medium storing a computer program for causing a computer to execute each step in a method for controlling an image processing apparatus defined in claim 7.

* * * * *